US006823155B2

(12) United States Patent
Tsuda et al.

(10) Patent No.: US 6,823,155 B2
(45) Date of Patent: Nov. 23, 2004

(54) PROCESS CARTRIDGE AND IMAGE FORMING APPARATUS

(75) Inventors: Tadayuki Tsuda, Susono (JP); Kazuo Chadani, Shizuoka-ken (JP); Daisuke Abe, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 09/988,153

(22) Filed: Nov. 19, 2001

(65) Prior Publication Data

US 2002/0061205 A1 May 23, 2002

(30) Foreign Application Priority Data

Nov. 17, 2000 (JP) ..... 2000-351040

(51) Int. Cl.[7] ..... G03G 15/00; G03G 21/16
(52) U.S. Cl. ..... 399/111
(58) Field of Search ..... 399/110, 111, 399/119, 116

(56) References Cited

U.S. PATENT DOCUMENTS

| | | | | |
|---|---|---|---|---|
| 4,873,549 A | | 10/1989 | Tada et al. | 355/206 |
| 5,126,800 A | | 6/1992 | Shishido et al. | 355/211 |
| 5,963,759 A | * | 10/1999 | Kojima et al. | 399/111 |
| 6,081,676 A | * | 6/2000 | Inomata | 399/111 X |
| 6,144,815 A | | 11/2000 | Chadani et al. | 399/27 |
| 6,173,140 B1 | | 1/2001 | Suzuki et al. | 399/113 |
| 6,301,457 B1 | | 10/2001 | Chadani et al. | 399/167 |
| 6,334,035 B1 | | 12/2001 | Abe et al. | 399/106 |
| 6,424,811 B1 | * | 7/2002 | Tsuda et al. | 399/167 |
| 6,512,903 B2 | | 1/2003 | Chadani | 399/106 |
| 6,519,431 B1 | * | 2/2003 | Toba et al. | 399/111 |
| 2002/0012546 A1 | | 1/2002 | Chandai | 399/106 |

FOREIGN PATENT DOCUMENTS

| | | |
|---|---|---|
| JP | 63-214765 | 9/1988 |
| JP | 5-080651 | 4/1993 |
| JP | 9-311610 | 12/1997 |
| JP | 2000-235301 | 8/2000 |

* cited by examiner

*Primary Examiner*—Fred Braun
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a developer discharging member; a cartridge positioning portion for engagement with a main assembly positioning portion provided in the main assembly when the cartridge is mounted to the main assembly; a photosensitive member driving force receiving portion for receiving a driving force for rotating the photosensitive member from the main assembly when the cartridge is mounted to the main assembly; and a discharging member driving force receiving portion for receiving a driving force for rotating the developer discharging member from the main assembly when the cartridge is mounted to the main assembly. The rotational directions of the photosensitive member driving force receiving portion and the discharging member driving force receiving portion are the same, and the rotation directions are such that a rotation moment is produced so as to contact the cartridge positioning portion to a lower surface of the main assembly positioning portion of the apparatus.

9 Claims, 30 Drawing Sheets

PROCESS CARTRIDGE AND IMAGE FORMING APPARATUS

BACKGROUND OF THE INVENTION

FIELD OF THE INVENTION AND RELATED ART

The present invention relates to a process cartridge and an electrophotographic image forming apparatus.

Here, an electrophotographic image forming apparatus is an apparatus which forms an image on a recording medium with the use of an electrophotographic image formation method. As examples of an image forming apparatus, there are an electrophotographic copying machine, an electrophotographic printer (for example, a laser printer, an LED printer, and the like), a facsimile machine, a word processor, and the like.

A process cartridge is a cartridge which integrally comprises a charging means, a developing means or a cleaning means, and an electrophotographic photosensitive drum, and is removably mountable in the main assembly of an electrophotographic image forming apparatus. It also is a cartridge which integrally comprises a minimum of one means among a charging means, a developing means, and cleaning means, and an electrophotographic photosensitive drum, and is removably mountable in the main assembly of an electrophotographic image forming apparatus, and a cartridge which integrally comprises a minimum of a developing means, and an electrophotographic photosensitive drum, and is removably mountable in the main assembly of an electrophotographic image forming apparatus.

A process cartridge system is employed by an electrophotographic image forming apparatus which employs an electrophotographic formation process. According to a process cartridge system, an electrophotographic photosensitive member, and a single or a plurality of processing means, which act on the electrophotographic photosensitive member, are integrated in the form of a cartridge removably mountable in the main assembly of an image forming apparatus. A process cartridge system makes it possible for a user to maintain an electrophotographic image forming apparatus without relying on service personnel, remarkably improving the operational efficiency of an electrophotographic image forming apparatus. Therefore, a process cartridge system is widely used in the field of an electrophotographic image forming apparatus.

Referring to FIG. 33, a conventional process cartridge 85 comprises a development unit and a cleaning unit, which are joined with each other with the use of connecting pins 89. The development unit comprises a developing means container 83 and a toner container 86, which are welded to each other by ultrasonic welding. The developing means container 83 supports a development roller 18. The cleaning unit comprises a photosensitive drum 11, a charge roller 12, a cleaning blade 14, a cleaning means container 87, and the like. The photosensitive drum 11, the charge roller 12, the cleaning blade 14, and the like, are supported by the cleaning means container 87. Further, a pair of compression springs 82 are placed in a compressed state between the cleaning means container 87 and developing means container 83, keeping the photosensitive drum 11 and development roller 18 pressed toward each other.

In the case of an electrophotographic image forming apparatus employing a process cartridge such as the one described above, there is a tendency that in order to extend the process cartridge replacement interval, in other words, in order to extend the length of the service life of a process cartridge, a toner container (developer container) and a cleaning means container are increased in capacity.

SUMMARY OF THE INVENTION

The present invention is the result of the further development of the prior art. The primary object of the present invention is to provide a process cartridge and an electrophotographic image forming apparatus, which ensure that a driving force is reliably transmitted from the main assembly of the image forming apparatus to the process cartridge.

Another object of the present invention is to provide a process cartridge and an electrophotographic image forming apparatus, which ensure that the process cartridge reliably receives the driving force for driving an electrophotographic photosensitive member and a developer sending member.

Another object of the present invention is to provide a process cartridge and an electrophotographic image forming apparatus, which ensure that a developer sending member is reliably driven.

According to an aspect of the present invention, there is provided a process cartridge detachably mountable to a main assembly of an electrophotographic image forming apparatus. The process cartridge includes an electrophotographic photosensitive member; a developing member for developing an electrostatic latent image formed on the electrophotographic photosensitive member; a developer accommodating portion for accommodating a developer to be used for development of the electrostatic latent image by the developing member, a developer discharging member for discharging the developer accommodated in the developer accommodating portion toward the developing member; a cartridge positioning portion for engagement with a main assembly positioning portion provided in the main assembly of the apparatus when the process cartridge is mounted to the main assembly of the apparatus, the cartridge positioning portion being disposed at a developer accommodating portion side in a direction crossing with a direction of an axis of the electrophotographic photosensitive member; a photosensitive member driving force receiving portion for receiving a driving force for rotating the electrophotographic photosensitive member from the main assembly of the apparatus when the process cartridge is mounted to the main assembly of the apparatus, the photosensitive member driving force receiving portion being disposed at a leading side with respect to a direction of mounting the process cartridge to the main assembly of the apparatus, wherein the process cartridge is mounted to the main assembly of the apparatus in the direction of the axis of the electrophotographic photosensitive member; and a discharging member driving force receiving portion for receiving a driving force for rotating the developer discharging member from the main assembly of the apparatus when the process cartridge is mounted to the main assembly of the apparatus. The rotational directions of the photosensitive member driving force receiving portion and the discharging member driving force receiving portion when the photosensitive member driving force receiving portion and the discharging member driving force receiving portion receive driving forces from the main assembly of the apparatus, are the same, and the rotation of directions are such that a rotation moment is produced so as to contact the cartridge positioning portion to a lower surface of the main assembly positioning portion of the apparatus.

According to a further aspect of the present invention, there is provided a process cartridge and an electrophotographic image forming apparatus, which are characterized in that the process cartridge is mounted into an apparatus main assembly in a direction cartridge comprises: a cartridge positioning portion which is located on the same side as the developer storing portion, in terms of the direction perpendicular to the axial direction of the electrophotographic photosensitive member, and engages with the cartridge positioning portion of the main assembly of the image forming apparatus; a photosensitive member driving force receiving portion, which is for receiving the driving force for driving the electrophotographic photosensitive member, from the apparatus main assembly, when the process cartridge is in the proper position in the apparatus main assembly, and which is located at the leading end of the process cartridge, in terms of the direction in which the process cartridge is mounted into the apparatus main assembly; and a developer sending member driving force receiving portion, which is for receiving the driving force for rotating the developer sending member, from the apparatus main assembly, and which is located at the leading end of the process cartridge in terms of the direction in which the process cartridge is mounted into the apparatus main assembly.

Another object of the present invention is to provide a process cartridge having a toner discharging or sending member which ensures that even if the process cartridge is substantially increased in toner capacity, compared to a conventional process cartridge, images of satisfactory quality are always formed, and also to provide an electrophotographic image forming apparatus compatible with such a process cartridge.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

The preferred embodiments of the present invention will be described with reference to FIGS. 1–9. In the following embodiments of the present invention, the longitudinal direction is such a direction that is perpendicular to the direction in which the recording medium is conveyed, and that is parallel to the surface of the recording medium. The top and bottom surfaces of a process cartridge are the top and bottom surfaces of the process cartridge which has been properly mounted in the main assembly of an image forming apparatus.

(Description of Process Cartridge and Main Assembly of Image Forming Apparatus)

Figure 1:
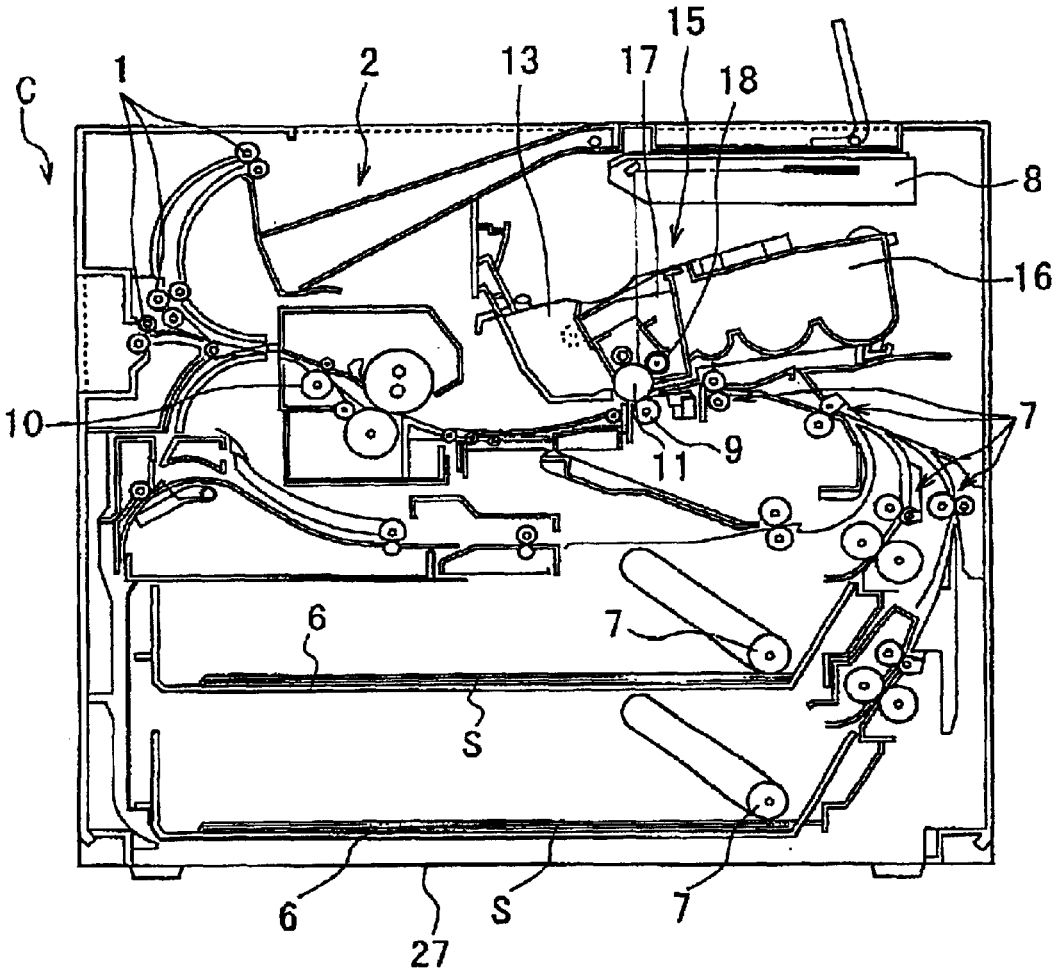
FIG. 1 is a vertical sectional view of an electrophotographic image forming apparatus.
Figure 2:
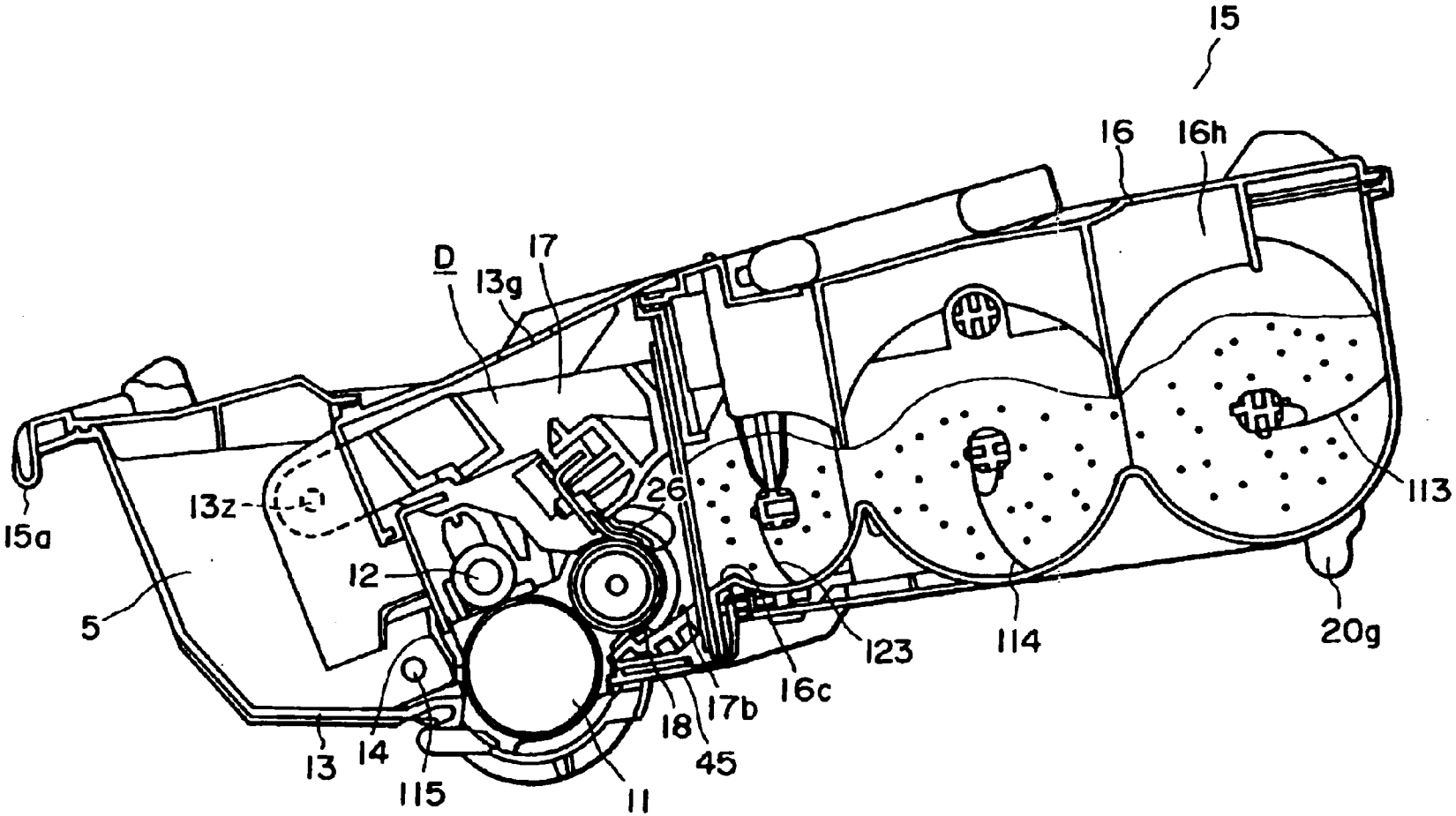
FIG. 2 is a vertical sectional view of a process cartridge.

FIG. 2 is a sectional view of a process cartridge in accordance with the present invention, at a plane perpendicular to the longitudinal direction, and FIG. 1 is a sectional view of an image forming apparatus in accordance with the present invention, at a plane perpendicular to the longitudinal direction. This process cartridge comprises an electrophotographic photosensitive member, and a plurality of processing means which act on the electrophotographic photosensitive member. As for the processing means, there are a charging means for charging the peripheral surface of the electrophotographic photosensitive member, a developing means for forming a toner image on the electrophotographic photosensitive member, and a cleaning means for removing the toner remaining on the peripheral surface of the electrophotographic photosensitive member.

Referring to FIG. 2, in the process cartridge 15 in this embodiment, a charging member 12 as a charging means, a development roller as a developing means, a development blade as a developing means, and a cleaning blade 14 as a cleaning means, are positioned around the electrophotographic photosensitive drum 11. These components are integrally covered with a housing, forming the process cartridge 15 which is removably mountable in the main assembly 27 of an image forming apparatus (which hereinafter will be referred to Was an apparatus main assembly).

Referring to FIG. 1, this process cartridge 15 is mounted in an electrophotographic image forming apparatus C to be used for image formation. In an image forming operation, a sheet S is conveyed by a conveying roller 7 from a sheet cassette 6 mounted in the bottom portion of the apparatus main assembly. In synchronism with the conveyance of the sheet S, a latent image is formed by selectively exposing the peripheral surface of the photosensitive drum 11 with the use of an exposing apparatus 8. Thereafter, the toner stored in a toner container 16 is coated in a thin layer on the peripheral surface of the development roller 18 by the development blade 26, while being triboelectrically charged. Then, the toner on the development roller 18 is supplied to the peripheral surface of the photosensitive drum 11, in accordance with the latent image, by applying a development bias to the development roller 18. As a result, a toner image is formed on the peripheral surface of the photosensitive drum 11. This toner image is transferred onto the sheet S as a recording medium, which is being conveyed, by the application of bias voltage to the transfer roller 9. Then, the sheet S is conveyed to a fixing apparatus 10, in which the toner image is fixed to the sheet S. Thereafter, the sheet S is discharged into a sheet delivery portion 2 at the top of the apparatus main assembly, by a discharge roller 1.

On the other hand, after the image transfer, the toner remaining on the photosensitive drum 11 is removed by the cleaning blade 14, and is moved inward of a removed toner bin 5 by a removed toner moving member 115.

(Structure of Process Cartridge Frame)

Figure 7:
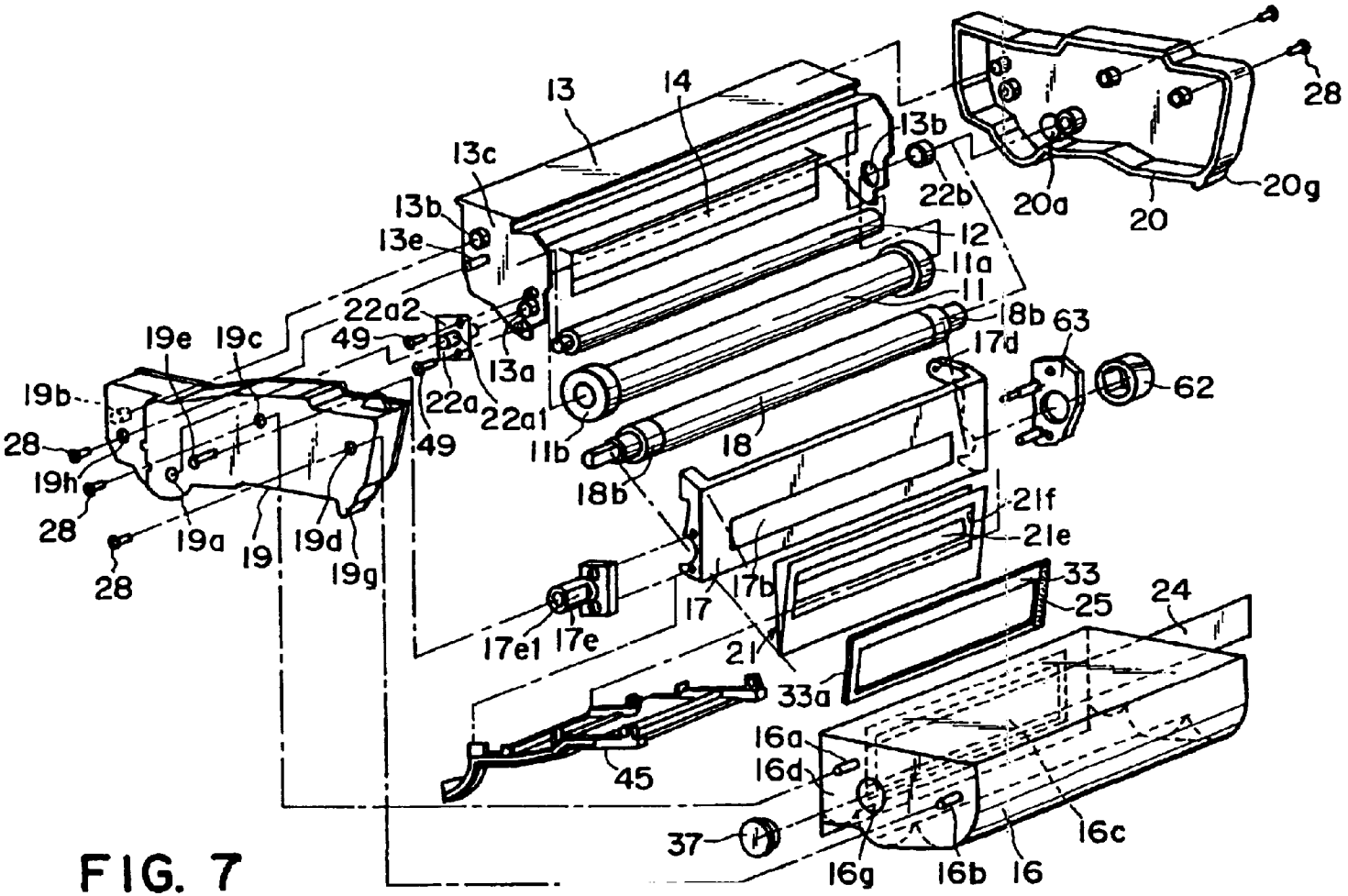
FIG. 7 is an exploded perspective view of the process cartridge.

FIGS. 3–9 are drawings for showing the structure of the process cartridge frame. FIG. 7 is a drawing which shows the components of the process cartridge prior to their assembly. FIGS. 3–6 are drawings of the process cartridge after its assembly. The process cartridge 15 comprises three frames: a cleaning means holding frame 13, which integrally supports the photosensitive drum 11, charging roller 12, and cleaning blade 14; a developing means holding frame 17 (which may be referred to as a development frame) which integrally supports the development roller 18, and a development blade (which is not shown in FIG. 7, and is shown in FIG. 2, being designated by a reference numeral 26); and a developer holding frame 16 which constitutes a developer container 16h for holding developer (which hereinafter will be referred to as toner). The toner container 16 is provided with a cover 45, which is attached to the bottom of the developer holding frame 16 and will be referred to as a bottom cover. In addition, the process cartridge 15 comprises a pair of side covers 19 and 20 (which sometimes will be referred to as side covers), which are fixed to the longitudinal ends, one for one, of both the cleaning means holding frame 13 and the toner container 16. The developing means holding frame 17 is supported by the cleaning means holding frame 13. Hereinafter, the frame which supports the photosensitive drum 11 may be referred to as a drum frame.

As described above, the process cartridge 15 has the bottom cover 45, which is attached to the process cartridge 15, at a location which will be below the development roller 18 as a developing member, and a development blade 26 as a developing member after the mounting of the process cartridge 15 in the apparatus main assembly 27. It constitutes a part of the external wall of the process cartridge 15. One end of the bottom cover 45 in terms of the longitudinal direction is connected to the side cover 19, or a first end cover on the rear end of the process cartridge 15 in terms of the process cartridge insertion direction, and the other end of the bottom cover 45 is connected to the side end cover 20, or a second end cover on the front end of the process cartridge 15 in terms of the process cartridge insertion direction.

Figure 3:
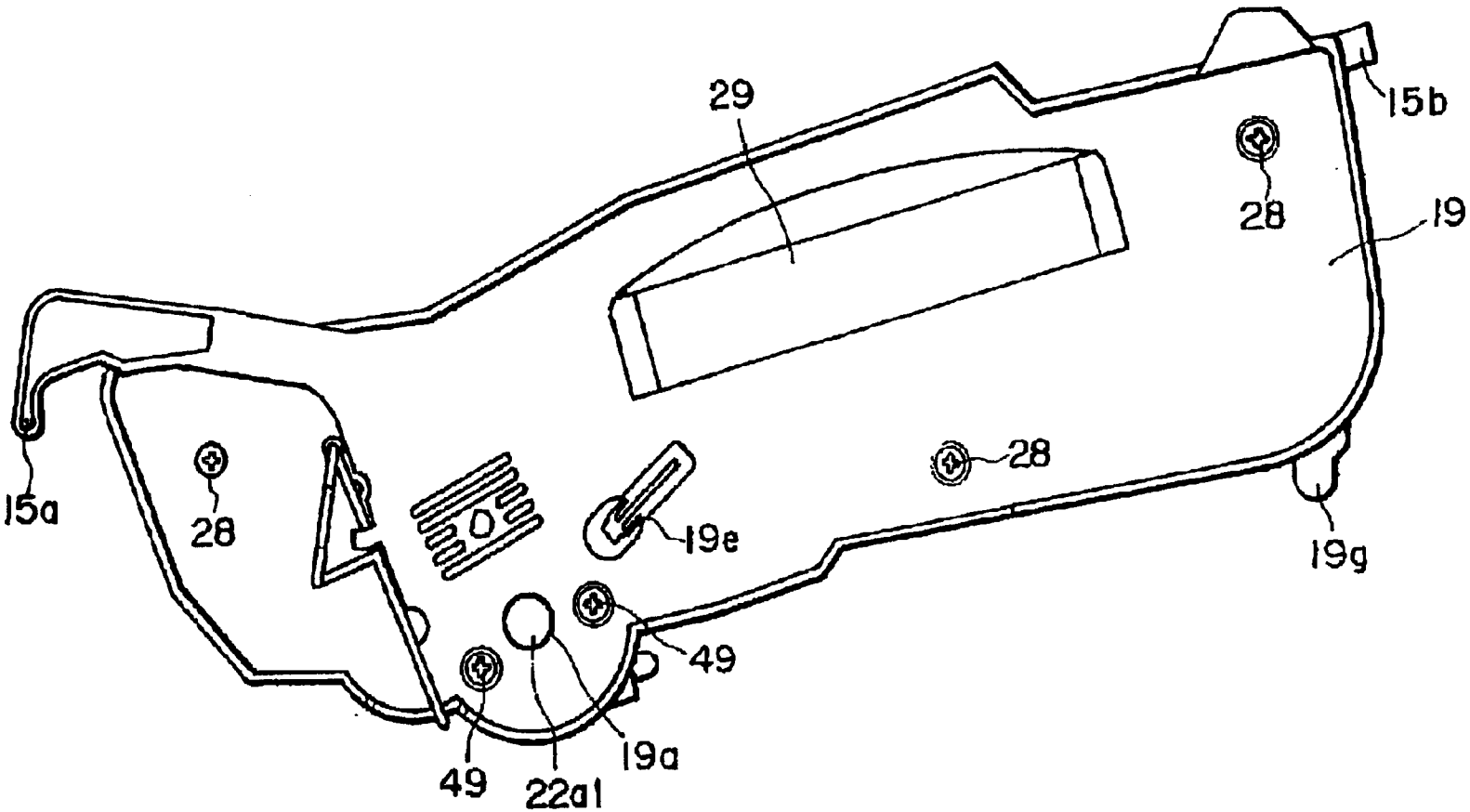
FIG. 3 is a front view of the process cartridge.

Referring to FIG. 3, the side cover 19 has a handle 29, which is grasped by an operator when the process cartridge 15 is mounted into or dismounted from the apparatus main assembly 27 by the operator. The process cartridge 15 is mounted into or removed from the apparatus main assembly 27 in a direction parallel to the longitudinal direction of the photosensitive drum 11. More specifically, when the process cartridge 15 is mounted into the apparatus main assembly 27, it is inserted all the way into the apparatus main assembly 27 in the longitudinal direction, and then, is lowered into the apparatus main assembly 27, whereas when it is removed from the apparatus main assembly 27, it is first moved upward and then is pulled out in the longitudinal direction.

The side cover 19 is provided with a hole 19*a*, through which a shaft 22*a*1, the axial line of which coincides with the that of the shaft which bears the photosensitive drum, extends outward. The shaft 22*a*1 is a part of a bearing member 22a with which one of the longitudinal ends of the photosensitive drum 11 is supported by the cleaning means holding frame 13. It is accurately positioned relative to the apparatus main assembly 27 as the process cartridge 15 is mounted into the apparatus main assembly 27. More specifically, first, the process cartridge 15 is inserted straight into the apparatus main assembly 27 as far as possible, and then, is lowered into the apparatus main assembly 27. As the process cartridge 15 is lowered, the shaft portion (positioning member) 22*a*1 engages into the positioning recess (which will be described later) of the apparatus main assembly 27, and guide portions 19*g* and 20*g*, also called rotation controlling portions 19*g* and 20*g*, or cartridge rotation controlling portions 19*g* and 20*g*, are supported by the apparatus main assembly 17.

Figure 5:
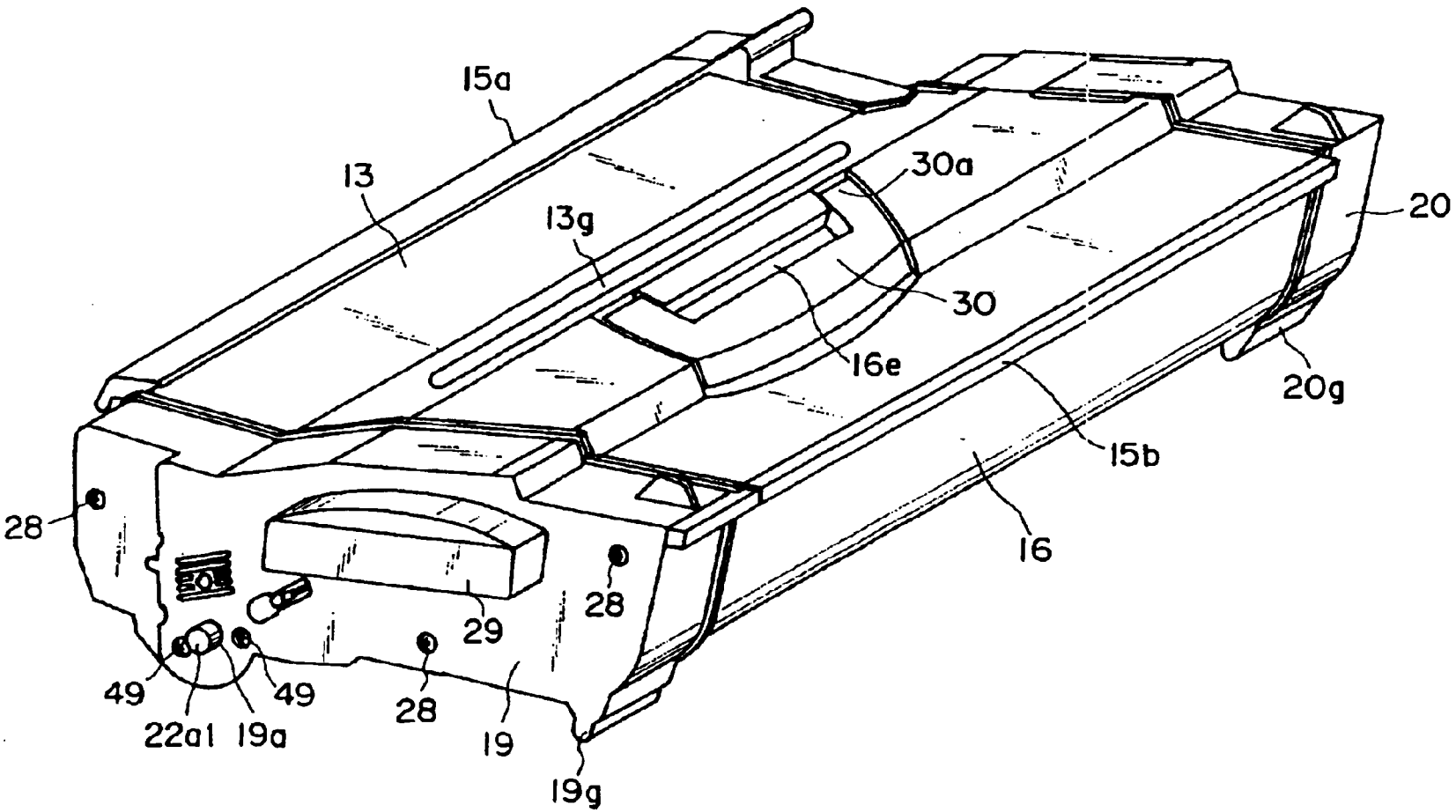
FIG. 5 is a perspective view of the process cartridge as seen from diagonally above the top right of the rear end of the process cartridge in terms of the direction in which the process cartridge is mounted.
Figure 6:
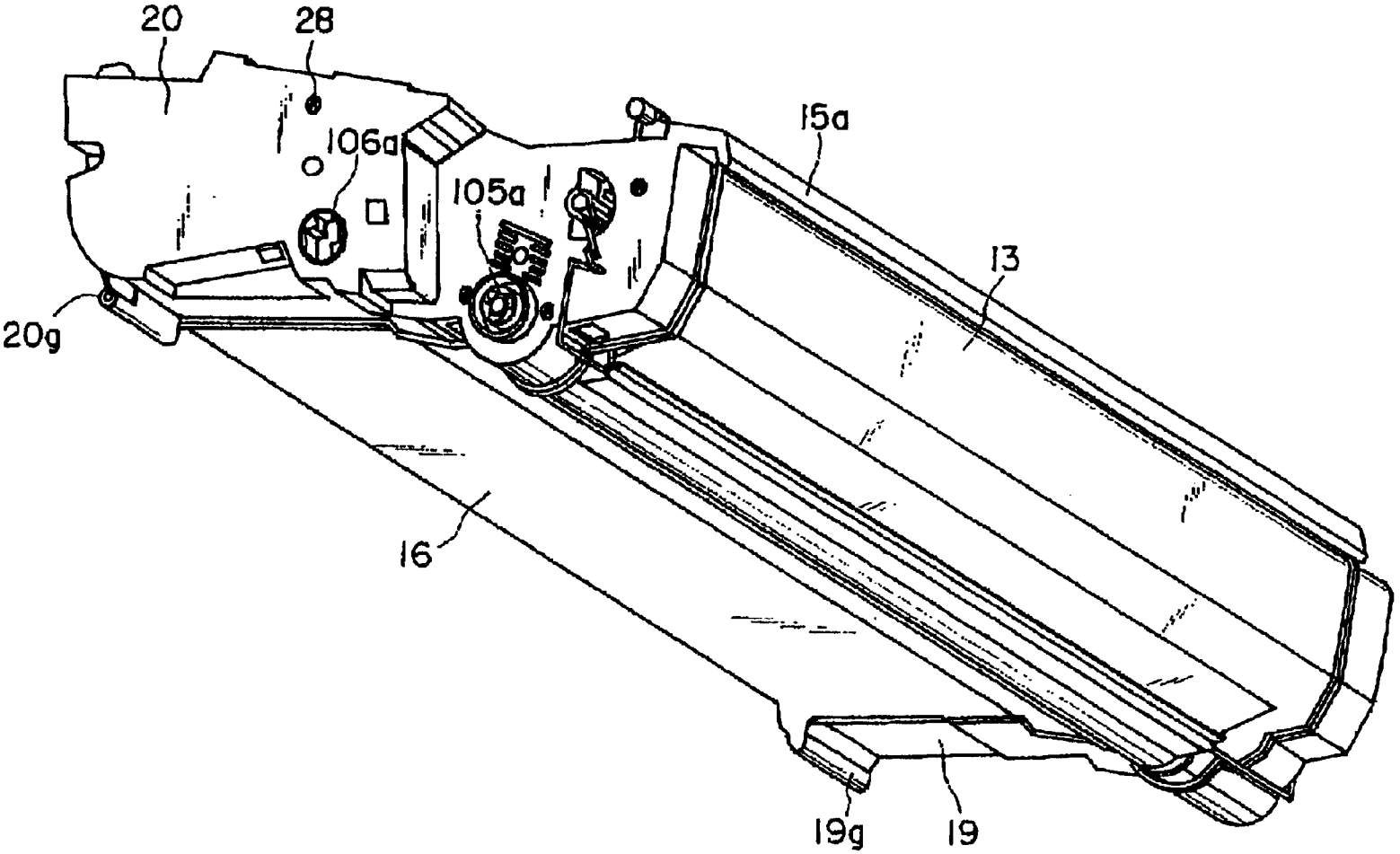
FIG. 6 is a perspective view of the process cartridge as seen from diagonally below the bottom right of the front end of the process cartridge in terms of the process cartridge mounting direction.

Referring to FIG. 5, the toner container 16 is provided with a handle 30, which is on the top surface of the process cartridge 15. Here, the top surface of the process cartridge 15 means a surface of the process cartridge 15, which faces upward after the mounting of the process cartridge 15 into the apparatus main assembly 27. The handle 30 is a handle which is grasped by an operator when the process cartridge 15 is carried. It folds into the recess 16*e* in the top surface of the toner container 16. It is attached to the toner container 16 by its base portions 30*a* with the use of pins (unshown) parallel to the longitudinal direction. When the handle 30 is used, it is rotated about the pins to the position at which it becomes upright relative to the top surface of the process cartridge 15.

Figure 4:
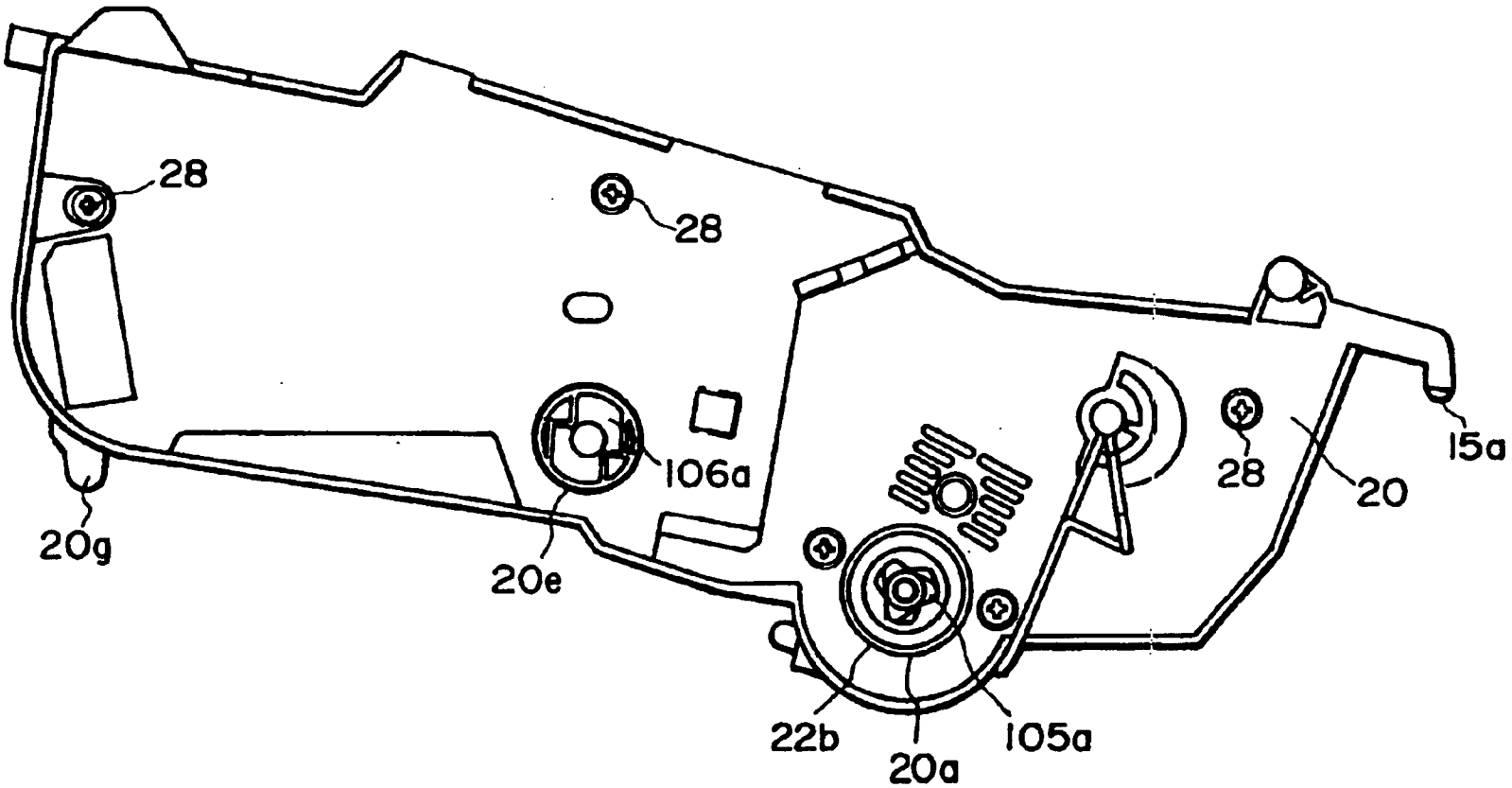
FIG. 4 is a rear view of the process cartridge.

Referring to FIGS. 2 and 5, the cleaning means holding frame 13 is provided with an exposure opening 13*g*, through which the light, which is projected from the exposing apparatus 8 of the apparatus main assembly 27 while being modulated with image formation information, is allowed to enter the process cartridge 15 to expose the photosensitive drum Referring to FIGS. 4 and 7, the side cover 20 is provided with a first hole 20*a* and a second hole 20*e*. In the first hole 20*a*, a first coupling 105*a* is fitted, which is a first driving force receiving portion for receiving the driving force for rotating the photosensitive drum 11 from the apparatus main assembly 27 after the mounting of the process cartridge 15 into the apparatus main assembly 27. The first coupling 105*a* is an integrally formed part of a flange 11*a*. The flange 11*a* is fixed to one of the longitudinal ends of the photosensitive drum 11. In the second hole 20*e*, a second coupling 106*a* as a second driving force receiving portion is fitted, which receives, from the apparatus main assembly 27, the driving force for rotating stirring members 113, 114, and 123 (FIG. 2) as toner moving members for sending out the toner stored in the toner container 16 after the mounting of the process cartridge 15 into the apparatus main assembly 27.

The details of the developing means holding frame 17 will be given later.

The side covers 19 and 20 are large enough to virtually perfectly cover the corresponding ends of the process cartridge 15 in the direction in which the recording medium is conveyed (large enough to match in size and shape the cross section of the process cartridge 15 at a plane perpendicular to the longitudinal direction), and are located at the ends of the process cartridge 15 in the longitudinal direction, one for one. The side covers 19 and 20 each extend across the longitudinal ends of the cleaning means holding frame 13 and toner container 16, and are fixed to the cleaning means holding frame 13 and toner container 16, thereby holding the cleaning means holding frame 13 and toner container 16 together.

The positions of the side covers 19 and 20 are fixed relative to the cleaning means holding frame 13 and toner container 16 so that the centers of the holes 19*a* and 20*a* shown in FIG. 7 align with the axial line of the photosensitive drum 11 supported by the cleaning means holding frame 13. On the side cover 19 side shown in FIG. 7, the bearing member 22*a* is pressed into the hole 13*a* of the cleaning means holding frame 13, and small screws 49 are put through the flange 22*a*2 and are screwed into the cleaning means holding frame 13. The bearing member 22*a* comprises the flange 22*a*2 and the shaft 22*a*1 integrally formed with the flange 22*a*2. The shaft 22*a*1 is put through the hole 13*a*, and then, the end of the shaft 22*a*1 is slid into the center hole of the flange 11*b*. To one of the longitudinal ends of the photosensitive drum 11, the flange 11*b* is immovably fitted. Since the position of the side cover 19 relative to the cleaning means holding frame 13 is fixed by the outward shaft 22*a*1 of the bearing member 22*a*, the side cover 19 is accurately positioned relative to the photosensitive drum 11. The positioning portion 19*b*, that is, one of the joggles of the side cover 19, which is positioned as far as possible from the photosensitive drum 11, is fitted in the positioning portion 13*b*, that is, one of the holes of the side wall 13*c* of the cleaning means holding frame 13. With this arrangement, the side cover 19 is prevented from rotating about the axial line of the photosensitive drum 11. The side cover 19 is fixed to the side wall 13*c* of the cleaning means holding frame 13, that is, one of the end walls of the cleaning means holding frame 13 in terms of the longitudinal direction.

The toner container 16 is provided with cylindrical positioning portions 16*a* and 16*b*, which are on the side wall 16*d*, that is, one of the end walls of the toner container 16 in terms of the longitudinal direction. The positioning portions 16*a* and 16*b* project in the longitudinal direction. They are fitted in the positioning portions 19*c* and 19*d*, which are holes of the side cover 19. With this arrangement, the positions of the toner container 16 and side cover 19 relative to each other are fixed. The toner container 16 and the side cover 19, also called the rear end cover 19 are fixed to each other. The other end cover, or the side cover 20, is accurately positioned relative to the toner container 16 and cleaning means holding frame 13, and is fixed to them, in the same manner as is the side cover 19. That is, the shaft of the bearing member 22*b* fixed to the cleaning means holding frame 13 by being pressed into the cleaning means holding frame 13 is fitted in the hole 20*a* of the side cover 20, in such a manner that a portion of the bearing member 22*b* extends outward from the side cover 20. The bearing members 22*a* and 22*b* double as members for accurately positioning the process cartridge 15 relative to the apparatus main assembly 27.

(Method for Connecting Frames)

The cartridge frame is temporarily assembled prior to its permanent assembly. In the temporary assembly of the cartridge frame, the shaft 22*a*1 projecting from the cleaning means holding frame 13 is put through the hole 19*a* of the side cover 19; the positioning portion (cylindrical joggle ) 19*b* of the side cover 19 is put through the positioning hole 13*b* of the side wall of the cleaning means holding frame 13; and the positioning portions 16*a* and 16*b* of the end wall of the toner container 16, are put through the positioning portions (holes) 19*c* and 19*d* of the side cover 19. Also on the side cover 20 side, the side cover 20, the cleaning means holding frame 13, and the toner container 16 are joined with each other in the same manner as on the side cover 19 side. Since these components can be temporarily assembled as described, they are easy to handle or put together before they are permanently fixed to each other.

In order to fix the side cover 19 to the cleaning means holding Same 13 and the toner container 16, first small screws 28 are put through the positioning portions 19*c* and 19*d* and screwed into the positioning portions 16*a* and 16*b*. Also, an additional small screw 28 is put through the hole 19*h* of the side cover 19 and screwed into the hole of the joggle 13*e* of the cleaning means holding frame 13. The positioning portions 19*c* and 19*d*, and hole 19*h*, are step holes, the outward sides of which are smaller in diameter. The smaller diameter portions of the holes are large enough in diameter for the screws 28 to be put through, but are smaller in diameter than the positioning portions 16*a* and 16*b*, and the joggle 13*e*. The cleaning means holding frame 13 and the toner container 16 are held together by the side cover 20 in the same manner as they are by the side cover 19.

Incidentally, the cleaning means holding frame 13 and the toner container 16 may be held together by the side covers 19 and 20 with the use of resin. In such a case, the side covers 19 and 20, the cleaning means holding frame 13, and the toner container 16 are provided with resin flow paths, which must be formed along the joining edges of the side covers 19 and 20, the cleaning means holding frame 13, and the toner container 16, when these components are formed. Then, melted resin is poured into the resin flow paths from the gate of a metallic mold, which is different from the molds used for forming the side covers 19 and 20, through a resin pouring path set up between the gate and the resin flow paths. The poured melted resin is allowed to solidify in the resin flow paths to keep the cleaning means holding frame 13 and the toner container 16 together by the side covers 19 and 20. Before the pouring of the melted resin, the process cartridge 15 is temporarily assembled in advance, and placed in the metallic mold used for joining the cleaning means holding frame 13 and the toner container 16 by the side covers 19 and 20 with the use of resin.

The toner container 16 and the developing means holding frame 17 are provided with a hole 16*c* (FIG. 2) and a hole 17*b*, respectively, for supplying toner from the toner container 16 to the development roller 18. The toner container 16 and the developing means holding frame 17 are connected to each other, with the interposition of a seal 21 (FIG. 7), in such a manner that the aforementioned holes 17*b* and 16*c* form a through hole between the toner container 16 and the developing means holding frame 17. The position of the toner container 16 is fixed relative to the side covers 19 and 20, whereas the position of the developing means holding frame 17 is fixed relative to the cleaning means holding frame 13. Therefore, a certain amount of a gap must be provided between the developing means holding frame 17 and the toner container 16 because it is possible that the container and the frame may have dimensional errors. The position of the process cartridge 15 relative to the apparatus main assembly 27 is fixed as the position of the cleaning means holding frame 13 relative to the cartridge mounting portion of the apparatus main assembly 27 is fixed as the process cartridge 15 is inserted into the apparatus main assembly 27. Thus, there is a substantial difference in the weight of the toner container 16 between when the toner container contains a large amount of toner, and when it is empty. Therefore, it is possible for the toner container 16, and one or both of the side covers 19 and 20 to warp. For this reason, the seal 21 is formed of a flexible material.

With the provision of the above described structural arrangement, even if the amount of toner is increased, the increase does not adversely affect the development roller 18, because the load from the toner applies to the covers 19 and 20 and the development roller 18 is supported by the developing means holding frame 17. Therefore, it does not occur that an unnecessary load is exerted upon the photosensitive drum 11. As a result, quality images can be consistently obtained.

Figure 8:
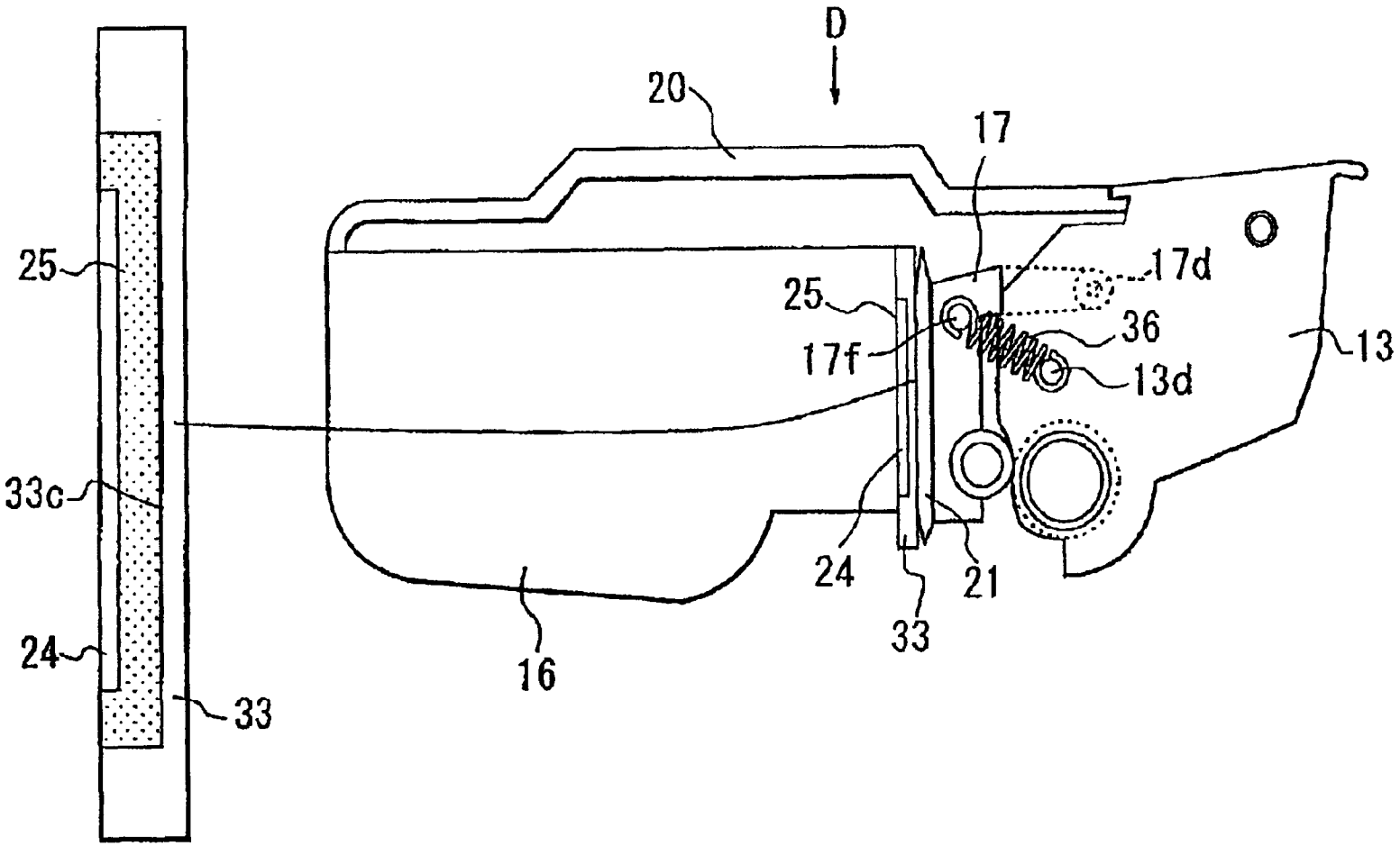
FIG. 8 is a rough rear view of the process cartridge, with the side cover removed.
Figure 9:
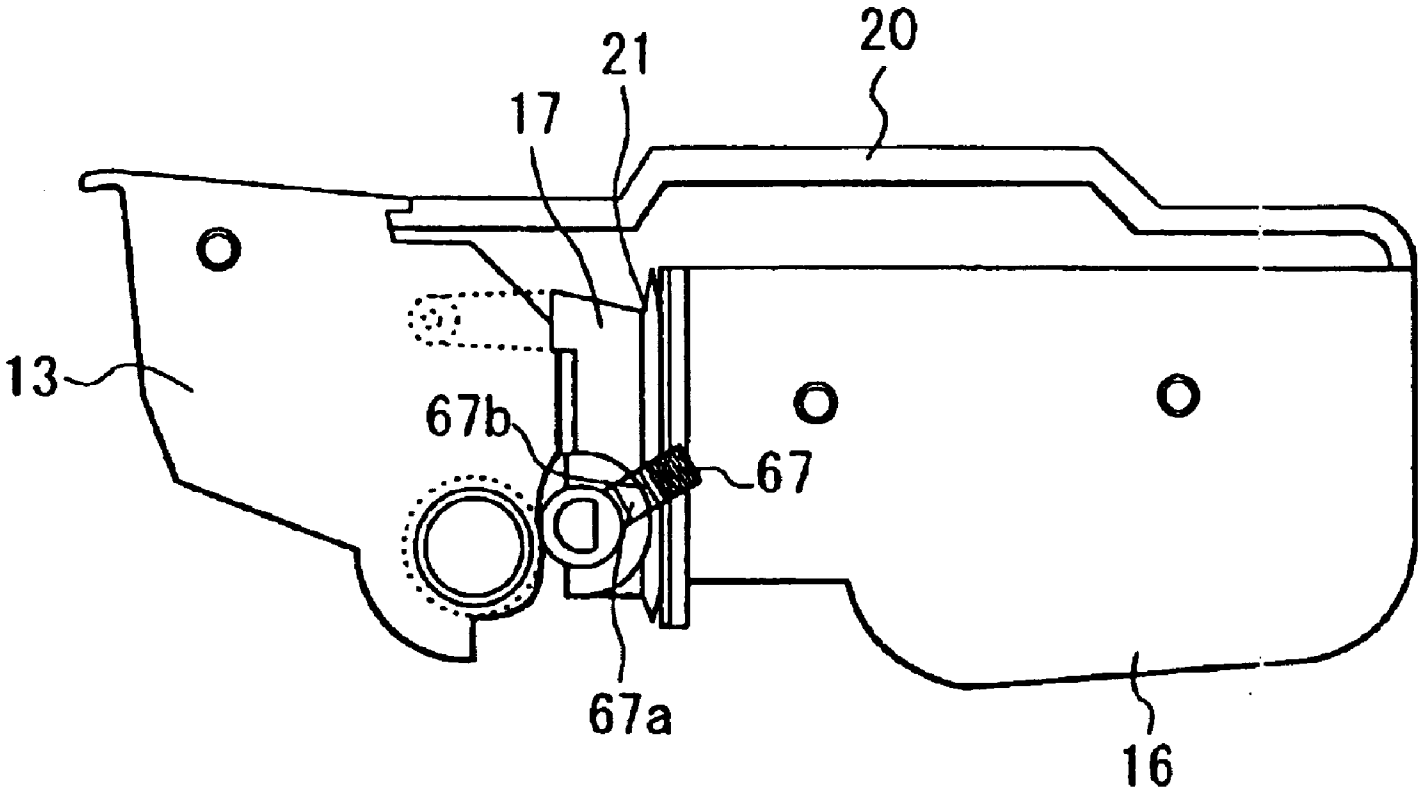
FIG. 9 is a rough front view of the process cartridge, with the side cover removed.

Referring to FIG. 2, at one of the longitudinal ends of the process cartridge, the developing means holding frame 17 of the developing apparatus D is connected to the cleaning means frame 13, with the use of a pin 66 (FIG. 20) anchored in the suspension hole 13*z* of the cleaning means holding frame 13, in such a manner that the developing means holding frame 17 is pivotable about the axial line of the suspension hole 13*z* while holding such developing means as the development roller 18, the development blade 26, and the like. Referring to FIG. 8, stretched between a spring mount 13*d* protruding from the cleaning means holding frame 13 and a spring mount 17*f* protruding from the developing means holding frame 17, is a coil spring 36. Regarding the spring mount 17*f*, its preferable version will be described later. Within the side cover 19, an elastic member 67 (FIG. 9), for example, a compression coil spring, is disposed in a manner to keep a projection 17*e* coaxial with the development roller bearing under the pressure from the elastic member 67. With the combination of the force from this elastic member 67 and the force from the tension coil spring 36, a pair of spacer rings 18*b*, which are coaxial with the development roller 18, are greater in radius by an amount equal to the development gap (approximately 300 m) than the development roller 18, and are fitted around the lengthwise ends of the development roller 18, one for one, and are kept pressed upon the photosensitive drum 11, outside the image formation area of the drum 11.

With the provision of the above described structural arrangement, a gap is present between the developing means holding frame 17 and the toner container 16. Further, the toner container 16 is configured so that its bottom wall is horizontal when it is properly positioned in the apparatus main assembly.

(Seal Configuration)

In this embodiment, the process cartridge 15 is structured so that the joint between the developing apparatus D and the toner container 16 remains sealed. More specifically, the seal 21 is folded in half, and the two halves of the seal 21 are pasted to each other, forming a sealing member in the form of a bellow, and this bellows-like sealing member is pasted to the developing apparatus D and the toner container 16. The seal 21 is attached to the toner container 16 with the interposition of a backing plate 33 as a connecting member. The seal 21 in this embodiment is no more than 1 mm in thickness. However, the thickness of the seal 21 may be more than 1 mm as long as a material, which does not reduce the flexibility of the seal 21 when the seal 21 is folded in the form of bellows, is selected as the material for the seal 21.

Figure 10:
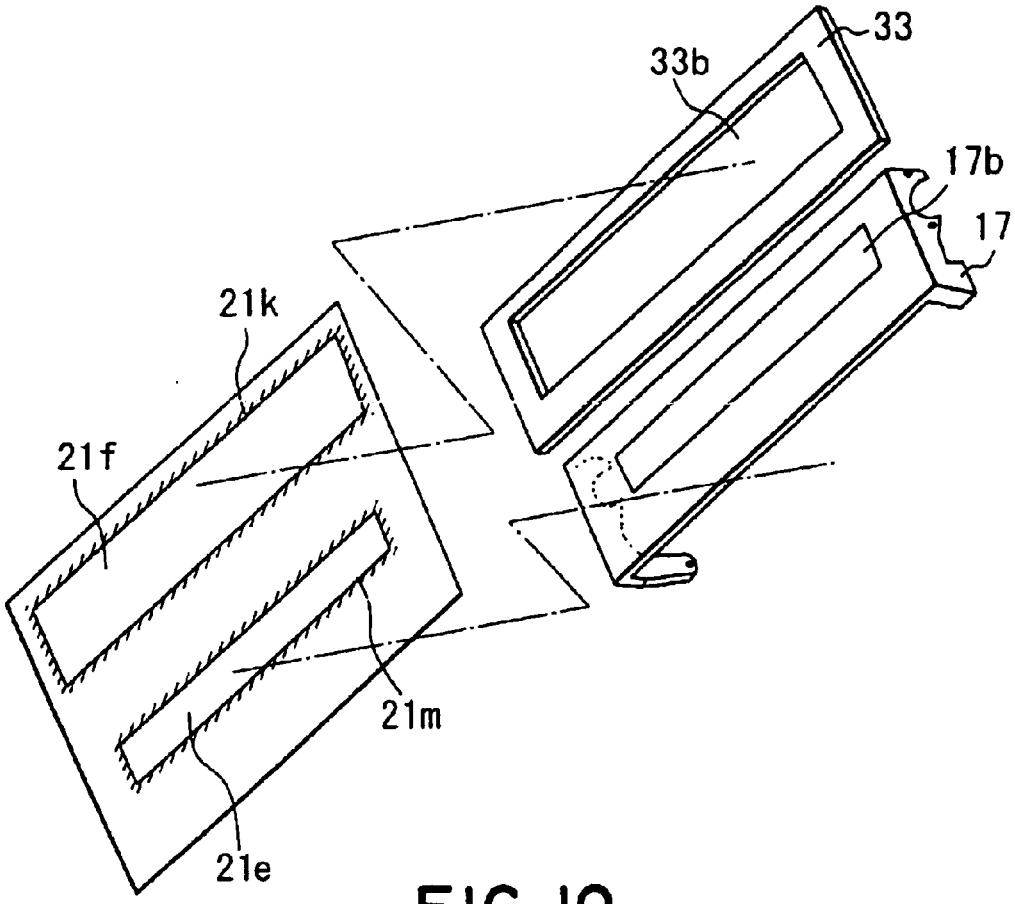
FIG. 10 is a perspective view of a sealing sheet for sealing between a toner container and a developing means holding frame, and components related to the sealing sheet.
Figure 11:
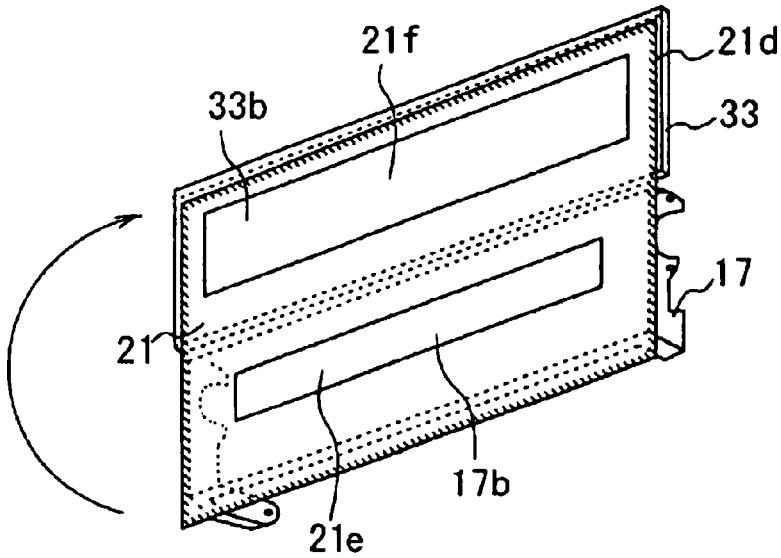
FIG. 11 is a perspective view of a sealing sheet for sealing between a toner container and a developing means holding frame, and components related to the sealing sheet.

Next, referring to FIGS. 10 and 11, a method for folding the seal 21 into a bellow-like sealing member will be roughly described. Referring to FIG. 10, the seal 21 is provided with holes 21*e* and 21*f*. The hole 21*e* is the same or larger in size than the hole 33*b* of the backing plate 33. The hole 21*f* is the same or larger in size than the hole 17*b* of the developing means holding frame 17.

The seal 21 is adhered to the backing plate 33 and the developing means holding frame 17 by first and second adhering portions 21*k* and 21*m*, respectively, that is, the surrounding edges (hatched portions in FIG. 10) of the holes 22*e* and 22*f*, so that the holes 22*e* and 22*f* align with the hole 33*b* of the backing plate 33 and the hole 17*b* of the developing means holding frame 17. As a result, the first hole 21*e* of the seal 21 is connected to the hole 17*b* of the developing means holding frame 17, forming a through hole, and the second hole 21*f* of the seal 21 is connected to the hole 33*b* of the backing plate 33, forming a through hole, as shown in FIG. 11.

In this embodiment, the developing means holding frame 17, the backing plate 33, and the seal 21 are thermally welded to each other by a heat seal method, an impulse seal method, or the like. However, they may be bonded by ultrasonic welding, adhesive, adhesive tape, or the like.

Next, referring to FIG. 11, after being pasted to the developing means holding frame 17 and the backing plate 33, the seal 21 is folded in the direction indicated by an arrow mark so that the holes 17*b* and 33*b* align with each other, with the interposition of the seal 21 between the developing means holding frame 17 and the backing plate 33. As a result, the seal 21 is shaped like a bellows (or a pouch). Then, the mutually facing halves of the seal 21 are joined to each other by their edges 21*d* (hatched portions), sealing between the developing means holding frame 17 and the backing plate 33. Also in this case, a thermal welding method such as a heat seal method or an impulse seal method, ultrasonic welding, adhesive, adhesive tape, or the like, may be used.

Next, the backing plate 33 is attached to the toner container 16. In this case, a portion of the backing plate 33 is not welded or glued to the toner container 16 so that a toner seal can be passed through between the toner container 16 and the backing plate 33.

In this embodiment, the backing plate 33 is welded by the portion or area 33*a*; the portion corresponding to the area across which the toner sealing member 25 presses upon the seal 24 is not welded or glued.

With the provision of the above-described structural arrangement, in other words, since the seal 21 as a sealing member forms a pouch or a bellows by being folded and welded, the resistance to the change in the gap between the mutually facing surfaces of the toner container 16 and the developing means holding frame 17, which occurs as the gap changes, is extremely small. Further, the interposition of the seal 21 between the backing plate 33 and the developing means holding frame 17 makes it possible to attach the backing plate 33 in a manner to cover the toner seal 24, and also to attach the toner sealing member 25 to the backing plate 33 in a manner to keep sealed the gap through which the toner seal 24 is passed. As a result, toner leakage is prevented.

Further, the provision of the backing plate 33 makes it possible to simplify the shape of a welding table necessary for welding, compared to a structural arrangement in which a sealing member in the form of a sheet is directly pasted to the toner container 16.

Further, the provision of the backing plate 33 makes it possible to unitize the seal 21 with the developing means holding frame 17, thereby making it easier to attach the seal 21 to the toner container 16.

(Method for Attaching Seal to Developing Means Holding Frame and Toner Container)

Here, a method for attaching to the developing means holding frame and the toner container, i.e., an extremely thin seal, which is for sealing between the developing means holding frame and the toner container, and also for connecting between the hole of the developing means holding frame and the hole of the toner container, will be described.

In this case, the seal 21 is no more than 0.1 mm in thickness. It is a single-layer sheet, and is kept on a backing sheet until it is used. Using a single-layer sheet as the material for the seal 21 makes it possible to render the seal 21 less rigid.

Figure 12:
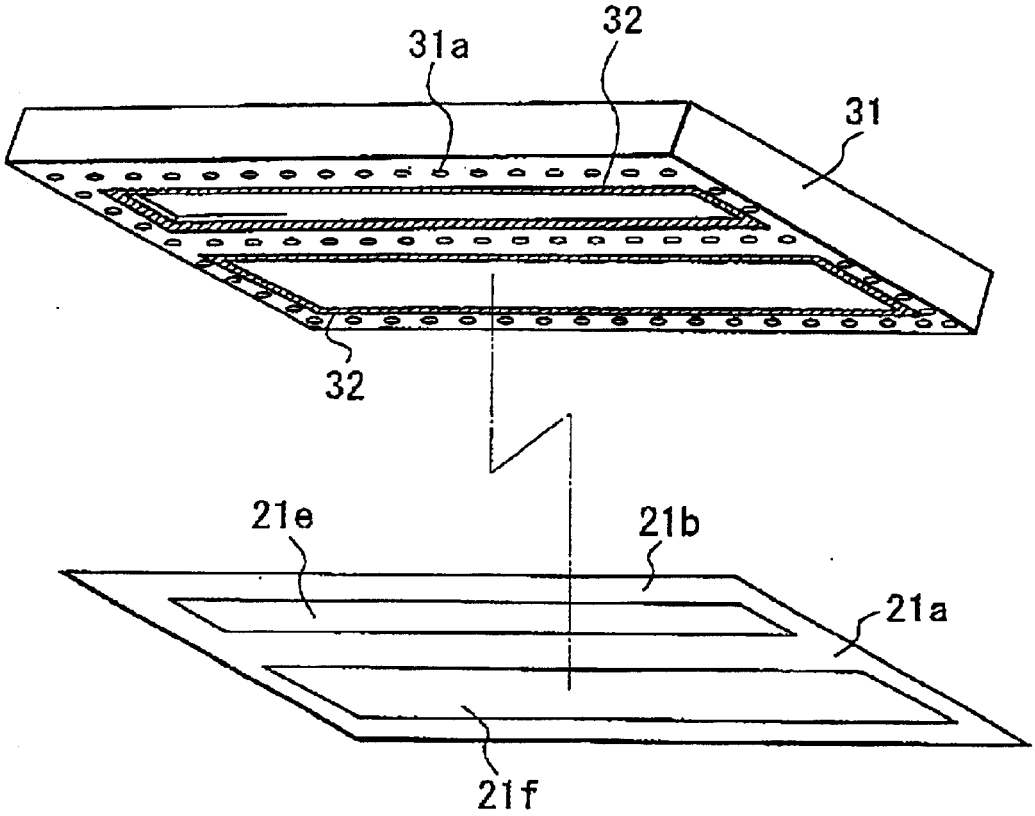
FIG. 12 is a perspective drawing for depicting how the sealing sheet is applied.

Referring to FIG. 12, the seal 21 in this case comprises a flexible layer 21*a* and a backing sheet 21*b*, which is more rigid than the layer 21*a*. The layer 21*a* is formed of polyethylene-terephthalate, polypropylene, biaxial orientation Nylon, a heat seal member, ester resin, ethylene vinyl acetate, polyurethane resin, polyester resin, olefin resin, or the like.

Next, a method for forming the seal 21 into a bellows will be described.

Figure 13:
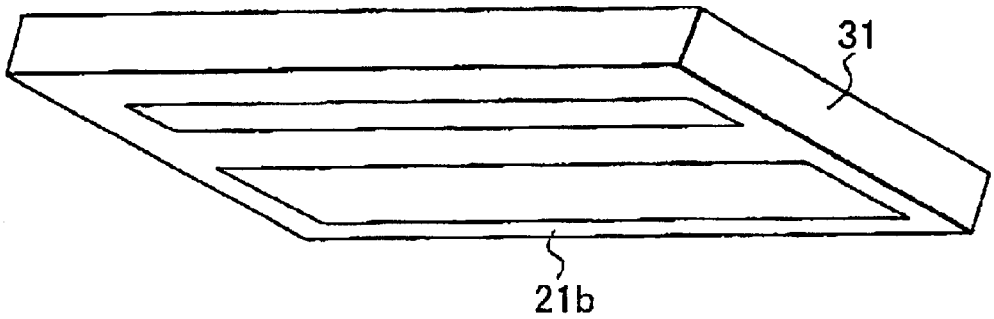
FIG. 13 is a perspective drawing for depicting how the sealing sheet is applied.
Figure 14:
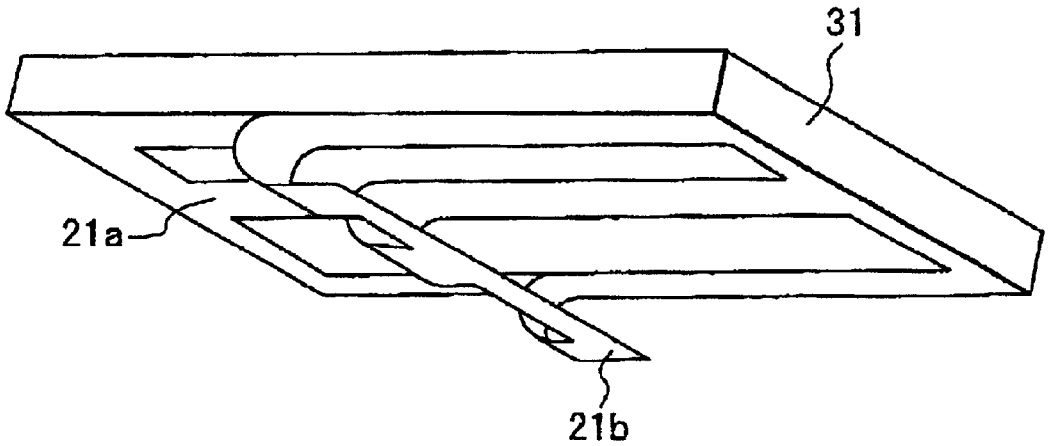
FIG. 14 is a perspective drawing for depicting how the sealing sheet is applied.

Referring to FIG. 12, a holding jig 31 for holding the seal 21 is provided with a plurality of holes 31*a* for holding the seal 21 by suction. These holes 31*a* are connected to an unshown vacuum pump. The seal 21 is held to the holding jig 31, with the layer 21*a* facing the holes 31*a*, as shown in FIG. 13. The seal 21 may be electrostatically held to the holding jig 31 by charging the surface of the holding jig 31. With the seal 21 held to the holding jig 31, the backing sheet 21*b*, or the second layer of the seal 21, is peeled as shown in FIG. 14, leaving only the layer 21*a* (actual seal 21) on the holding jig 31.

Figure 15:
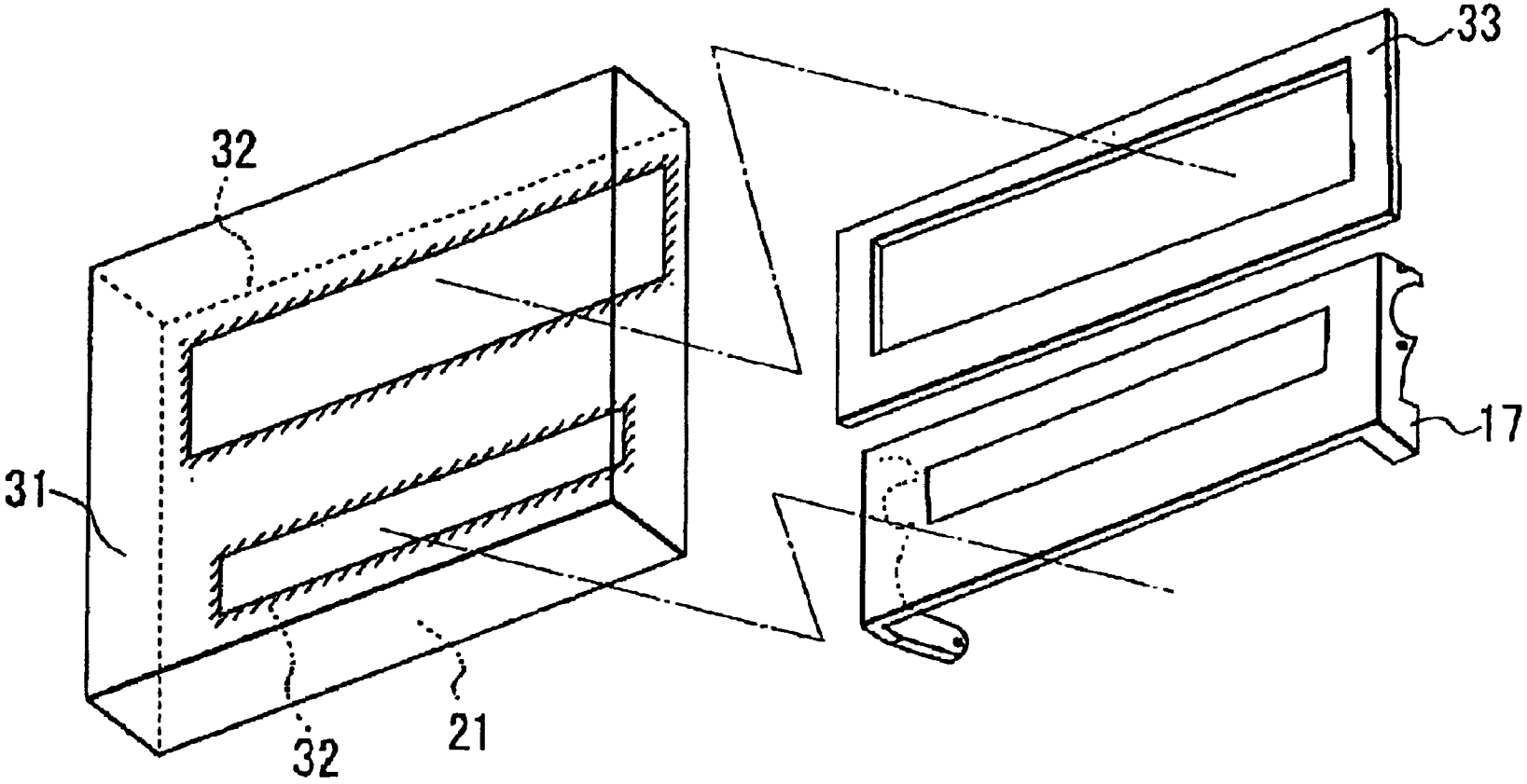
FIG. 15 is a perspective drawing for depicting how the sealing sheet is applied.

Also referring to FIG. 12, the holding jig 31 is provided with a heat generating member 32 for impulse sealing. Next, referring to FIG. 15, after the removal of the backing sheet 21*b*, the layer 21*a* of the seal 21 held by the holding jig 31 is pressed onto the backing plate 33 and the developing means holding frame 17. Next, with the layer 21*a* of the seal 21 being pressed onto the backing plate 33 and the developing means holding frame 17, electrical current is briefly flowed through the heat generating member 32 to generate heat, and then, the layer 21*a* of the seal 21 is allowed to cool. As a result, the layer 21*a* of the seal 21 becomes welded to the backing plate 33 and the developing means holding frame 17. Thereafter, the vacuum pump is stopped, and the holding jig 31 is raised to be moved away from the layer 21*a* of the seal 21, having become welded to the developing means holding frame 17 and the backing plate 33. The backing plate 33 functions as a part of the toner container 16. In other words, in reality, the hole 33*b* of the backing plate 33 becomes the hole of the toner container 16.

The seal 21 is adhered to the backing plate 33 and the developing means holding frame 17 in such a manner that the surrounding edges of the holes 21*e* and 21*f* of the seal 21 are adhered to the surrounding edge of the hole 33*b* of the backing plate 33, and the surrounding edge of the hole 17*b* of the developing means holding frame 17, respectively.

As a result, the seal 21 is welded to the developing means holding frame 17 and the backing plate 33 as shown in FIG. 11. Then, the seal 21 is folded in the direction indicated by the arrow mark in FIG. 11, so that the holes 21*e* and 21*f* face each other. Then, the mutually facing halves of the seal 21 are joined to each other by their edges 21*d* (hatched portions), forming a pouch which functions like bellows. The seal 21 may be folded so that the resultant pouch will be shaped like accordion bellows with a plurality of folds.

In this embodiment, ester film is used as the material for the layer 21*a* of the seal 21. However, hot melt film such as film of copolymer of ethylene and vinyl acetate or the like may be used.

Further, in this embodiment, the actual seal 21, or the layer 21*a*, is formed of single-layer film. Therefore, if a heat seal method, in which heat is continuously applied, is used, it is possible that the layer 21*a* of the seal 21 will be welded to the heating portion. Thus, the seal 21 should be welded by an impulse seal method in which the heating, cooling, and holding processes can be carried out in a short time.

In addition, ultrasonic welding, in which heat is instantaneously generated, or adhesive, adhesive tape, or the like, which does not involve heat, may be used.

With the provision of the above described structural arrangement, even if the layer 21*a* of the seal 21 is extremely thin, and is difficult to paste in a wrinkle free manner, it can be adhered to a target area while holding a proper shape by being supported by the backing sheet which is removed after the layer 21*a* is adhered.

Incidentally, a seal 21, which comprises a plurality of layers, may be used in place of the above described seal 21 in which the actual flexible seal layer 21*a* is formed of single-layer film. Also in such a case, the above described method for attaching the seal 21 can be used.

Next, the backing plate 33 is attached to the toner container 16. At this stage, a portion of the backing plate 33 is not welded or adhered to the toner container 16, being left unattached thereto, so that the toner seal 24 can be passed through between the backing plate 33 and the toner container 16.

Referring to FIG. 7, in this embodiment, the areas 33*a* are welded, and the area across which the toner sealing member 25 presses upon the developer seal 24 is not welded.

The toner sealing member 25 is an elastic member formed of felt or the like material. It is a long and narrow member and is attached to the backing plate 33, along the edge of one of the longitudinal ends of the backing plate 33, extending in the width direction of the backing plate 33. It is pasted to the bottom surface of the recess 33*c* in the backing plate 33 (FIG. 8).

With the provision of the above described structural arrangement, even if the gap between the mutually facing surfaces of the toner container 16 and the developing means holding frame 17 fluctuates, the resistance which occurs as the developing means holding frame 17 is displaced is extremely small, because the seal 21 is folded in the shape of a pouch or bellows, and is formed of very thin flexible film.

(Other Examples of Seal for Airtightly Sealing between Developing Means Holding Frame and Toner Holding Frame)

Figure 16:
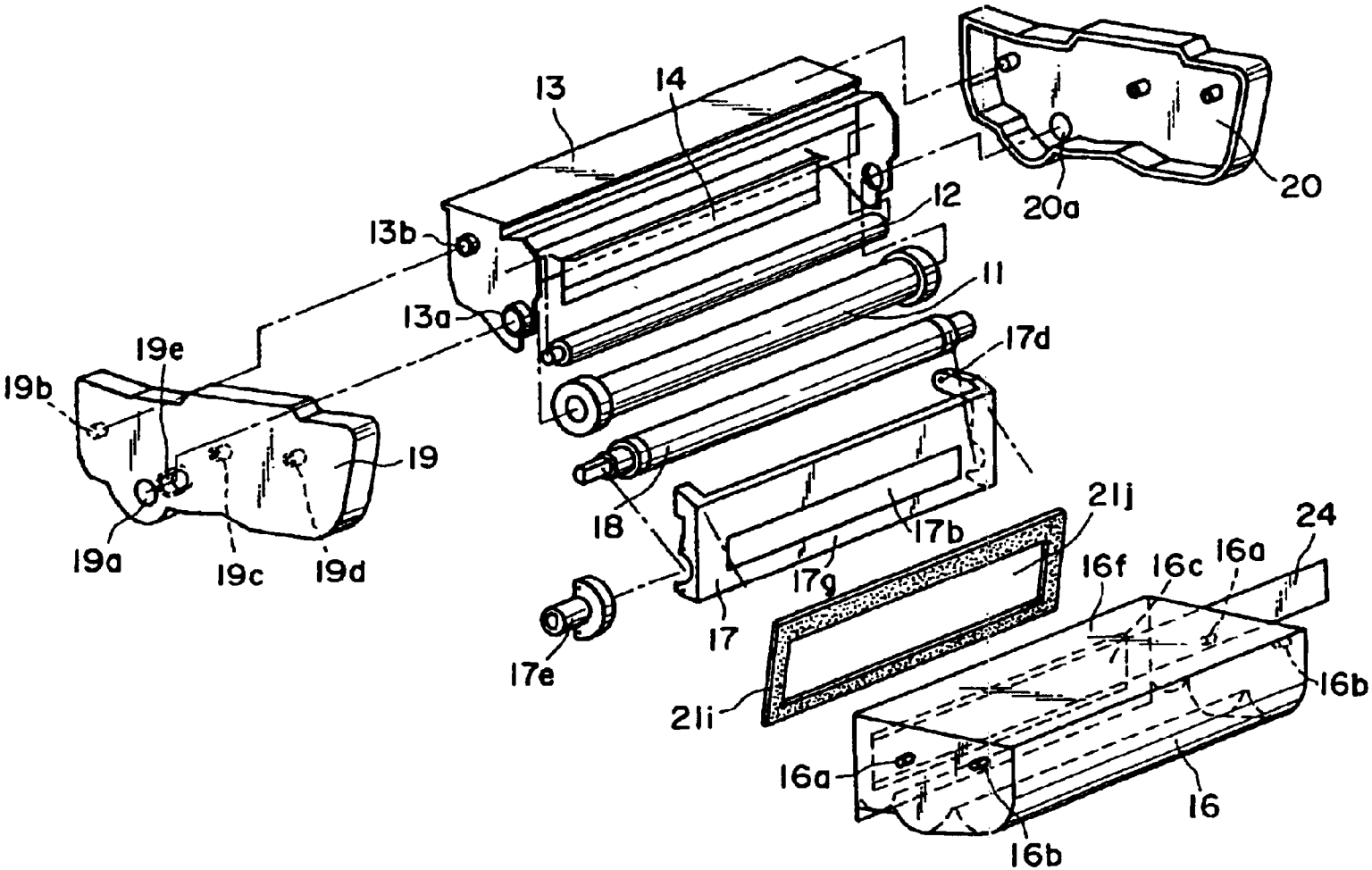
FIG. 16 is an exploded perspective view of the process cartridge, for showing the sealing sheet for sealing between a toner container and a developing means holding frame in another embodiment of the present invention.

FIG. 16 is an exploded perspective view of a process cartridge, for describing another example of a sealing member. FIG. 16 is a simplified version of FIG. 7, except that the seal in FIG. 16 is different from that in FIG. 7.

Figure 17:
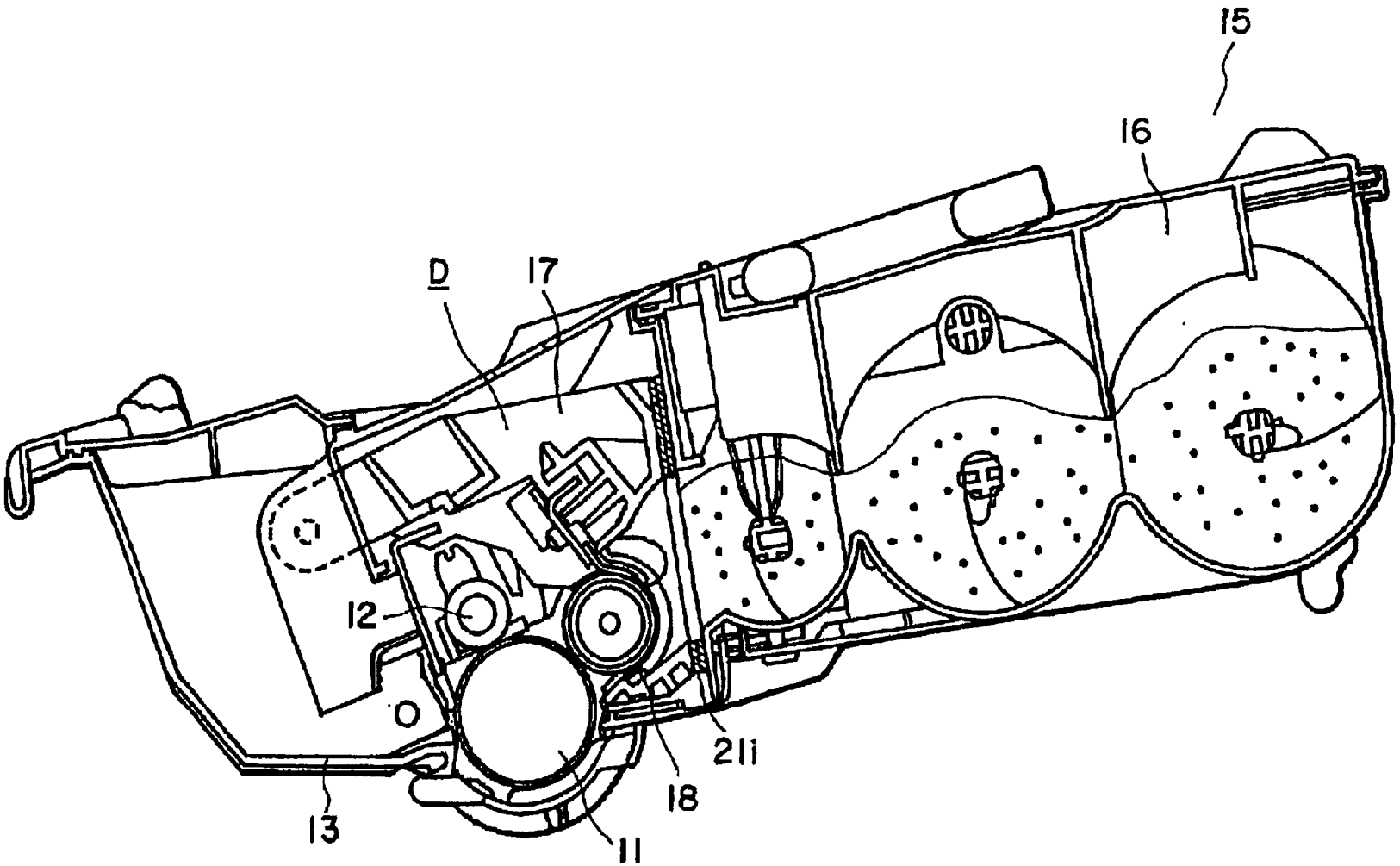
FIG. 17 is a vertical sectional view of the process cartridge, for showing the sealing sheet for sealing between a toner container and a developing means holding frame in another embodiment of the present invention.

FIG. 17 is a sectional view of a process cartridge at a plane perpendicular to the longitudinal direction of the process cartridge.

A seal 21*i* is in the form of a plate, and is formed of flexible material such as foamed synthetic resin (for example, foamed urethane), rubber with a relatively low level of hardness, silicone, or the like. It is provided with a hole 21*j*, which aligns with the hole 17*b* of the developing means holding frame 17, and the hole 16*c* of the toner container 16, as the seal 21*i* is mounted. The hole 21*j* of the seal 21*i* is approximately the same in size as the holes 17*b* and 16*c*. The seal 21*i* is pasted to one or both of the mutually facing surfaces of the developing means holding frame 17 and the toner container 16, except across the portion corresponding to the area through which the toner seal 24 is passed when it is pulled out of the process cartridge 15.

The thickness of the seal 21*i* before the process cartridge is assembled is greater than the distance between the mutually facing surfaces of the developing means holding frame 17 and the toner container 16, in particular, between the portion 17*g* surrounding the hole 17*b* of the developing means holding frame 17, and the portion 16*f* surrounding the hole 16*c* of the toner container 16, after the process cartridge is assembled.

Therefore, in the process cartridge 15 having been assembled as shown in FIG. 17, the seal 21*i* remains compressed by the mutually facing surfaces 17*g* and 16*f* of the developing means holding frame 17 and the toner container 16, respectively. The reactive force generated as the seal 21*i* is compressed acts as such force that presses the spacer rings 18*b* of the development roller 18 upon the photosensitive drum 11. Therefore, it is desired that the resiliency of the seal 21*i* is rendered as small as possible.

The employment of this seal 21*i* makes it possible to eliminate the need for the backing plate 33 described with regard to the preceding method for sealing between the toner container 16 and the developing means holding frame 17, and also, the seal 21*i* is easier to apply than the seal 21.

(Toner Seal)

The toner seal 24 seal is extended from one end of the hole 16*c* of the toner container 16 to the other to seal the hole 16*c*, and then, is folded back and doubled back beyond the starting point as shown in FIG. 7. Prior to the application of the toner seal 24, the stirring members 113, 114, and 123 are assembled into the toner container 16. After the application of the toner seal 24, toner is filled into the toner container 16 through the toner filling hole 16*g*. After the filling, a toner cap 37 is pressed into the toner filling hole 16*g*.

To summarize the description of the seal given above, the developing means holding frame 17 and the toner container 16 are connected by the flexible seal 21, which is pasted to the developing means holding frame 17 and the toner container 16.

The flexible seal 21 is provided with a through hole. One end of the thus provided through hole faces the developer supplying hole 16*c* of the toner container 16, and the other end of the through hole faces the developer receiving hole 17*b* of the developing means holding frame 17. The developer supplying hole 16*c* is a hole through which the toner stored in the toner storing portion 16*h* of the toner container 16 is conveyed toward the development roller 18 as a developing member. The developer receiving hole 17*b* is a hole through which toner is received into the developing means holding frame 17 after passing through the developer supplying hole 16*c*. The flexible seal 21 is pasted to the surrounding edge of one end of the above described through hole, and is pasted to the developing means holding frame 17 by the surrounding edge of the other end of the through hole. In other words, the opening 21*e*, or one end of the above described through hole, faces the developer receiving hole 17*b* of the developing means holding frame 17, and the opening 21*f*, or the other end of the through hole, faces the developer supplying hole 16*c* of the toner container 16.

After the connection between the toner container 16 and developing means holding frame 17, the flexible seal 21 is in the form of a pouch, with one of the mutually facing two halves of the flexible seal 21, or one side of the pouch, having the hole 17*e*, and the other half, or the other side of the pouch, having the hole 17*f*. The hole 17*f* of the one side of the pouch faces the developer supplying hole 16*c* of the toner container 16, whereas the hole 17*e* of the other side of the pouch faces the developer receiving hole 17*b* of the developing means holding frame 17. The developer supplying hole 16*c* is a hole through which the toner stored in the toner storing portion of the toner container 16 is conveyed toward the development roller 18 as a developing member. The developer receiving hole 17*b* is a hole through which toner is received into the developing means holding frame 17 after passing through the toner supplying hole 16*c*. The flexible seal 21 is pasted to the backing plate 33 provided as a part of the toner container 16, by the surrounding edge of the hole 21*f* of the above described one side of the pouch, and also is pasted to the developing means holding frame 17 by the surrounding edge of the hole 21*e* of the other side of the pouch.

After the flexible seal 21 is pasted to the developing means holding frame 17 and toner container 16, it has at least one fold, being shaped like a bellows, one end of which is pasted to the backing plate 33 provided as a part of the toner container 16, and the other end of which is pasted to the developing means holding frame 17.

The flexible seal 21 is formed of elastic material or a heat seal member.

In comparison, the flexible sheet 21*i*, or a different type of a flexible seal, is formed of foamed urethane, rubber with a relatively low degree of hardness, silicone, or the like.

(Developing Apparatus Structure)

It has been already described that a pair of tension springs 36 are placed in the stretched state between the developing means holding frame 17 and the cleaning means holding frame 13 (FIG. 8). The following is a further development of this structure.

Figure 18:
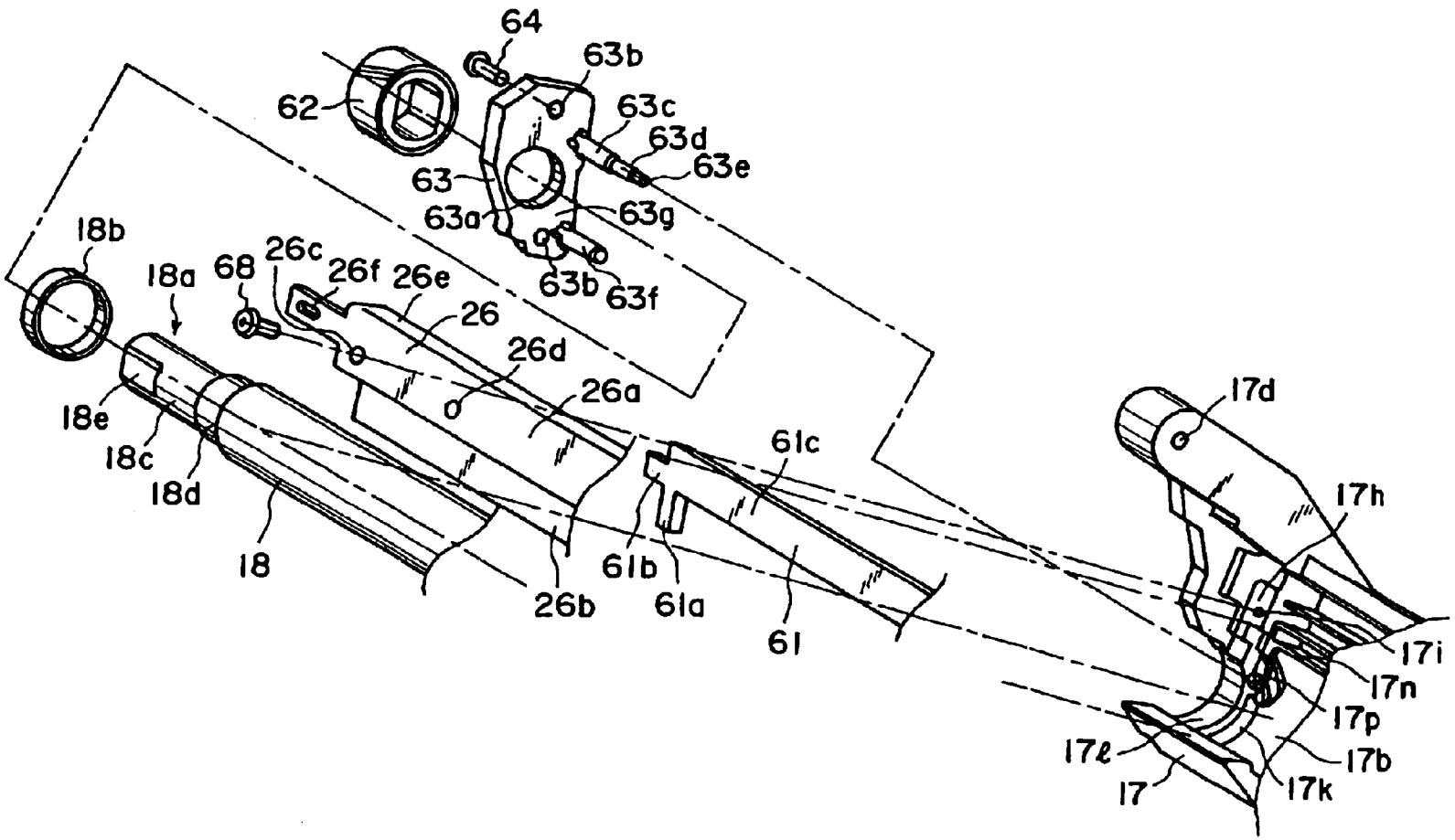
FIG. 18 is an exploded perspective view of a developing apparatus, for describing the structure for connecting a developing means holding frame and a cleaning means holding frame.
Figure 19:
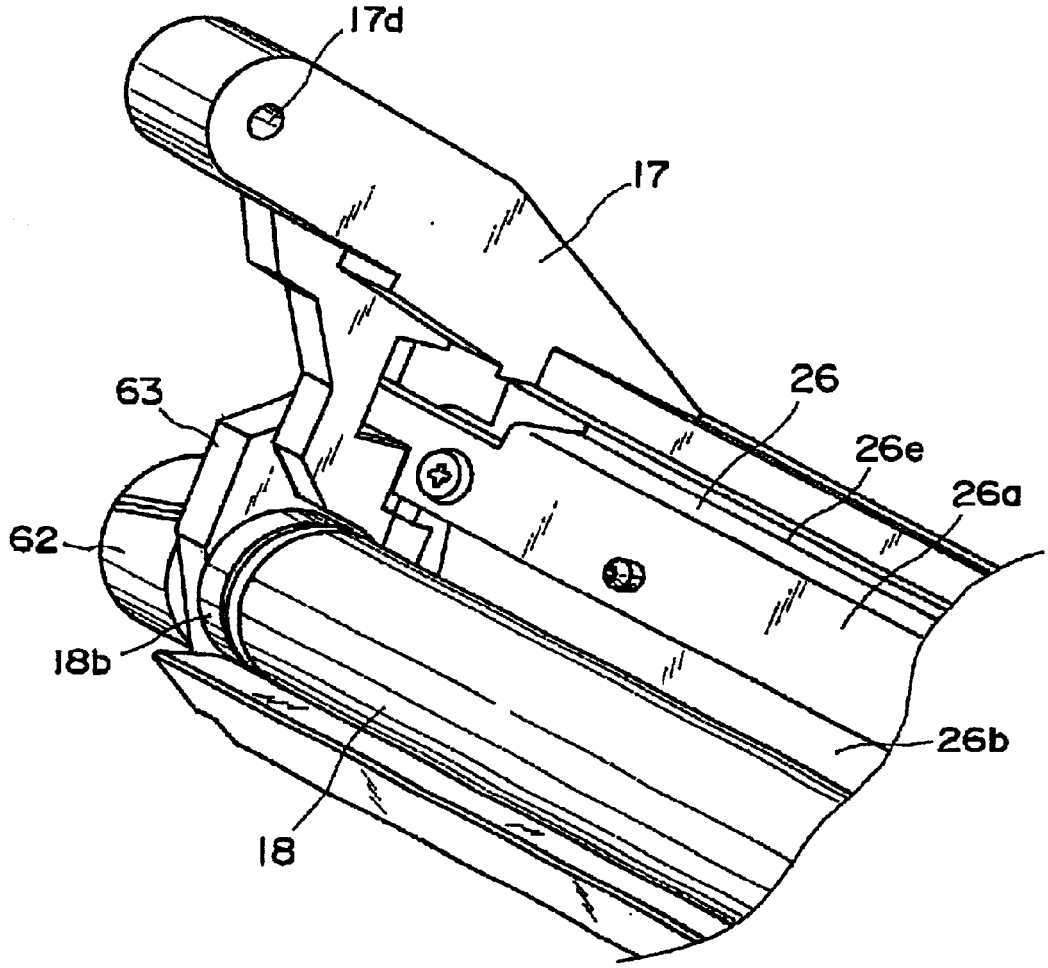
FIG. 19 is a perspective view of a portion of the developing apparatus.

Next, referring to FIGS. 18 and 19, the structure of the developing apparatus will be described. FIG. 18 is a perspective view of the components of the developing apparatus prior to their assembly, and FIG. 19 is a perspective view of the components of the developing apparatus after their assembly. The developing means holding frame 17 contains structural components such as the development roller 18, the development blade 26, and the like, which are involved in image formation. At this time, a description of the developing apparatus is given with reference to only one side, or the side cover 20 side, of the apparatus. However, the structure of the developing apparatus on the other side, or the side cover 19 side, is the same as that on the side cover 20 side.

The development blade 26 comprises a 1–2 mm thick metallic plate 26*a*, and a urethane rubber 26*b* fixed to the metallic plate 26*a* by hot melting, double-side adhesive tape, or the like. The amount of the toner on the peripheral surface of the development roller 18 is regulated by positioning the development blade 26 in such a manner that the urethane rubber 26*b* contacts the generatrix of the development roller 18. In some cases, silicon-rubber is used for the development blade 26. Referring to FIG. 18, the flat surface 17*h*, as a blade mounting portion, of the developing means holding frame 17 is provided with a hole 17*i* with female threads. It is also provided with a positioning joggle (unshown) which is located closer to the center of the developing means holding frame 17. The development blade 26 is placed on the developing means holding frame 17 so that the positioning joggle (unshown) of the developing means holding frame 17 fits through the hole 26*d* of the metallic plate 26*a*. Then, a small screw 68 is put through the screw hole 26*c* of the metallic plate 26*a* and is screwed into the hole 17*i* with female threads, to solidly fix the metallic plate 26*a* to the flat surface 17*h*. As a result, the position of the edge of the urethane rubber 26*b* is fixed, and therefore, the amount of the pressure applied to the development roller 18 by the urethane rubber 26*b* becomes fixed. In other words, the distance from the edge of the urethane rubber 26*b* to the contact point between the peripheral surface of the development roller 18 and the imaginary extension of the urethane rubber 26*b* toward the development roller 18 is set, determining thereby development conditions. In order to increase the rigidity of the metallic plate 26*a* of the development blade 26 so that the urethane rubber 26*b* evenly contacts the development roller 18 in terms of the longitudinal direction of the development roller 18, the metallic plate 26*a* is bent approximately 90° at a line parallel to the longitudinal direction, creating a bent portion 26*e*. Further, the metallic plate 26*a* is rendered long enough to protrude from both ends of the developing means holding frame 17 after its mounting into the developing means holding frame 17, and each of these protruding end portions of the metallic plate 26*a* is provided with a hole 26*f* for anchoring a pressure generating spring which will be described later.

The developing means holding frame 17 is provided with an elastic sealing member 61, which is pasted to the developing means holding frame 17 to prevent toner from leaking out. The elastic sealing member 61 is shaped like a letter U stretched in the direction of the horizontal stroke, extending along the top edge of the hole 17*b* from one end to the other (first straight portion 17*n*), and also extending a predetermined distance downward (second straight portion 17*p*) from the top of the shorter edge of the developer receiving hole 17*b*. It is formed of MOLTPRENE, or the like. The first and second straight portions 61*c* and 61*a* of the elastic sealing member 61 are pasted to the aforementioned first and second straight portions 17*n* and 17*p* of the developing means holding frame 17. This elastic sealing member 61 is sandwiched between the developing means holding frame 17 and the development blade 26, remaining thereby in the compressed state, to prevent toner from leaking out. The elastic sealing member 61 is also provided with an earlobe-like portion 61*b*, which protrudes several millimeters from the longitudinal end in the longitudinal direction, and plays a role in accurately positioning an unshown magnetic seal.

Each of the longitudinal ends of the developing means holding frame 17 is provided with a groove 17*k*, which is in the semicylindrical surface 17*l* of the developing means holding frame 17, the curvature of which matches that of the peripheral surface of the development roller 18. The groove 17*k* extends from the top to bottom ends of the semicylindrical surface 17*l*, along the edge of the hole 17*b*, perpendicular to the longitudinal direction. In the groove 17*k*, a magnetic seal (unshown) is attached to prevent toner from leaking, following the peripheral surface of the development roller 18, by the magnetic force of the magnetic seal.

The mandible-like portion of the developing means holding frame 17 is provided with a thin elastic sealing member (unshown), which is pasted to the mandible-like portion in a manner to contact the generatrix of the development roller 18.

The development roller 18 is a cylindrical member formed of metallic material such as aluminum or stainless steel. It is approximately 16–20 mm in external diameter, and 0.5–1 mm in wall thickness. In order to improve the efficiency with which developer is charged, the peripheral surface of the development roller 18 is coated with carbon, or blasted. In this embodiment, the peripheral surface of the development roller 18 has been simply coated with carbon.

The longitudinal ends of the development roller 18 are fitted with a sleeve flange 18*a* (one at one of the longitudinal ends is shown), which is a cylindrical member with a step portion, formed of a metallic material such as aluminum or stainless steel, and is pressed into the end of the development roller 18. The sleeve flange 18*a* is coaxial with the development roller 18, and has two cylindrical portions: a first cylindrical portion 18*d* with a larger diameter and a second cylindrical portion 18*c* with a diameter smaller than that of the first cylindrical portion. The first cylindrical portion 18*d* is fitted with a distance regulating member 18*b* in the form of a ring (which may be referred to as spacer ring) for regulating the distance (which hereinafter will be referred to as "SD gap") between the peripheral surfaces of the development roller 18 and the photosensitive drum 11. The spacer ring 18*b* is formed of dielectric material such as polyacetal. The external diameter of the spacer ring 18*b* is greater by twice the SD gap than the external diameter of the development roller 18. The second cylindrical portion 18*c* is fitted in a development roller bearing 63 (shown in FIG. 20, which is an enlarged perspective view of the end cover 20 side of the developing apparatus, on the side opposite to the side shown in FIG. 18 or 19) for accurately positioning the development roller 18 relative to the developing means holding frame 17 while rotationally supporting the development roller 18. The end portion 18*e* of the second cylindrical portion 18*c* has been flatted to give it the so-called double D cross section. A development roller gear 62 formed of synthetic resin is fitted around the cylindrical portion 18*c*, being prevented by this flatted portion 18*e* from rotating around the cylindrical portion 18*c*. The development roller gear 62 is driven by a helical drum gear (unshown) attached to one of the longitudinal ends of the photosensitive drum 11, and rotates the development roller 18. The teeth of the development roller gear 62 are twisted in the direction to thrust the development roller 18 toward the center of the developing apparatus. Within the development roller 18, a magnetic roll (which is not shown) for causing toner to adhere onto the peripheral surface of the development roller 18 is placed.

The development roller bearing 63 is a virtually flat member with an approximate thickness of 2–5 mm, and is formed of resinous material with a higher level of slipperiness. It has a cylindrical bearing portion 63*a*, which is located in the approximate center of a flat portion 63*g*. The internal diameter of the bearing portion 63*a* is in a range of 8–15 mm. In this bearing portion 63*a*, the second cylindrical portion 18*c* of the sleeve flange 18*a* is fitted to allow the development roller 18 to rotate, with the peripheral surface of the second cylindrical portion 18*c* sliding on the wall of the hole of the bearing portion 63*a*. The flat portion 63*g* is provided with a joggle 63*c*, which projects approximately in parallel to the axial line of the bearing portion 63*a* to accurately position the development roller bearing 63 relative to the developing means holding frame 17. The joggle 63*c* is divided into three portions: a base portion, a portion 63*d*, or the middle portion, and a portion 63*e*, or the end portion, which are coaxial. The portions 63*d* and 63*e* of the joggle 63*c* are used to accurately position the magnetic seal. Further, the flat portion 63*g* is provided with screw holes 63*b* for solidly fixing the development roller bearing 63 to the developing means holding frame 17, with the use of small screws 64 or the like. More specifically, the joggle: 63*c* of the development roller bearing 63 fits into an unshown hole provided in the end wall of the developing means holding frame 17 in terms of the longitudinal direction, and the joggle 63*f* of the development roller bearing 63 fits into another unshown hole, with the elongated cross section, of the same end wall of the developing means holding frame 17, so that the flat portion 63*g* of the development roller bearing 63 flatly contacts the above described end wall of the developing means holding frame 17. Then, the small screws 64 are put through the corresponding screw holes of the development roller bearing 63, and screwed into the corresponding unshown female threaded holes of the developing means holding frame 17. With this structural arrangement, the development blade 26 and the development roller 18 are accurately positioned relative to the developing means holding frame 17, assuring that high quality images are consistently outputted.

In some cases, a highly slippery substance (for example, polyphenylene sulfide, or polyamide), which is relatively costly, is used as the material for the bearing portion 63*a* of the development roller bearing 63 in order to allow the sleeve flange 18*a* to smoothly rotate. In such cases, the cost of the development roller bearing 63 can be reduced by dividing the development roller bearing 63 into a bushing portion which actually bears the development roller 18, and a housing portion, because only the bushing portion, or the portion with a smaller volume, requires highly slippery material, whereas the housing portion, or the substantial portion of the development roller bearing 63, may be formed of relatively inexpensive material such as high impact polystyrene or the like.

Within the development roller 18, a magnetic roll (unshown) for causing toner to adhere onto the peripheral surface of the development roller 18 is placed.

(Structure for Supporting Developing Apparatus)

Figure 20:
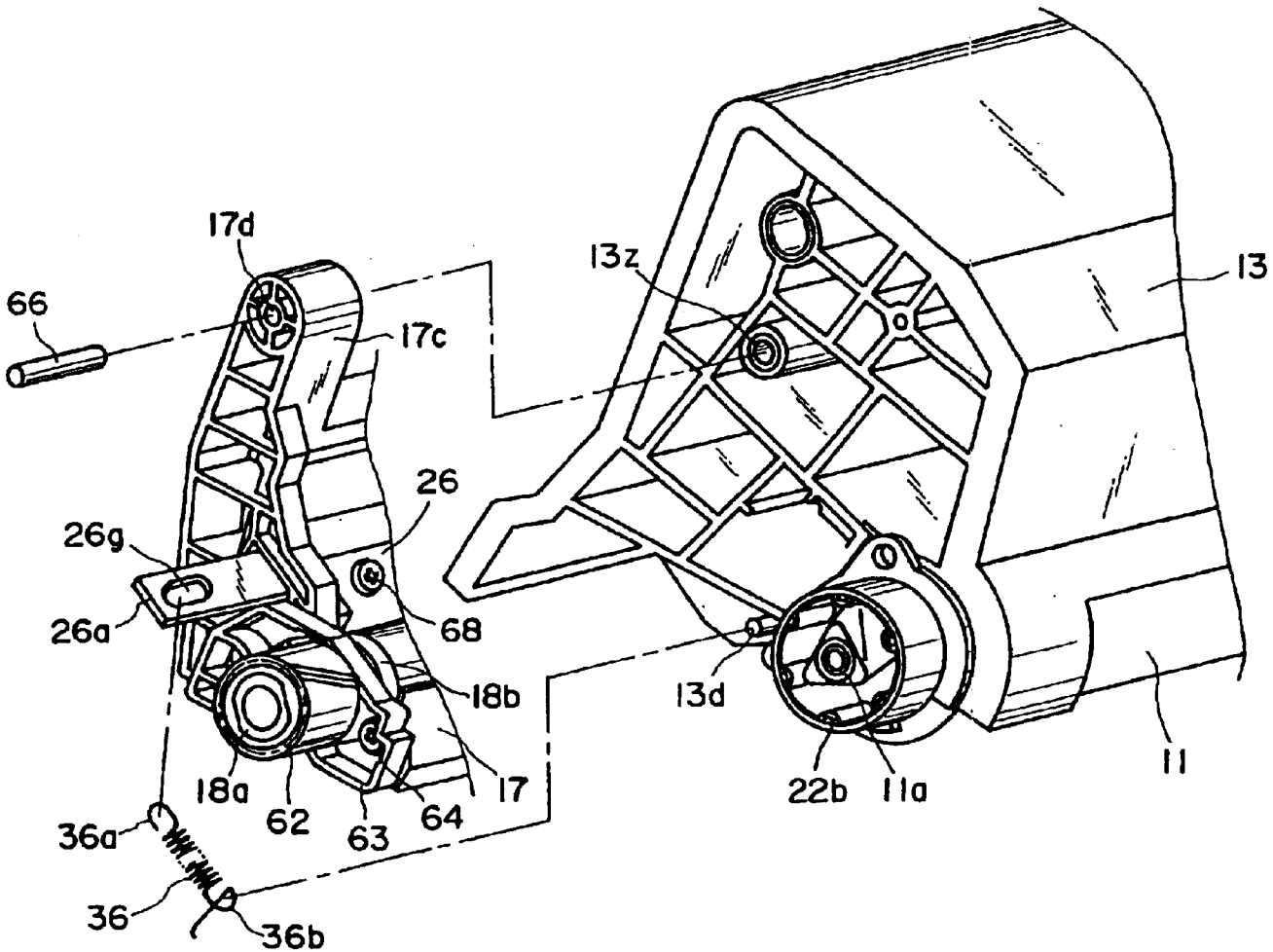
FIG. 20 is an exploded perspective view of the structure for connecting the developing apparatus and cleaning means holding frame.
Figure 21:
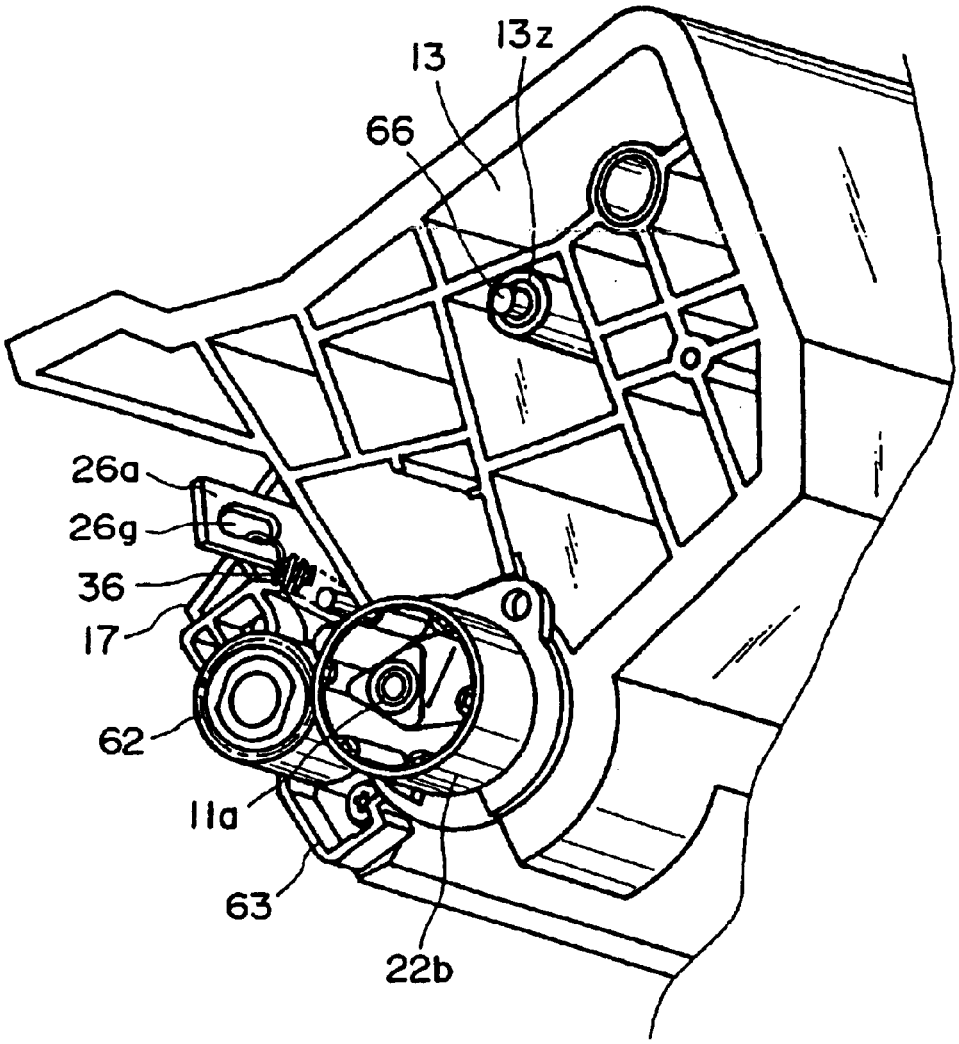
FIG. 21 is a perspective view of the structure for connecting the developing apparatus and cleaning means holding frame.
Figure 22:
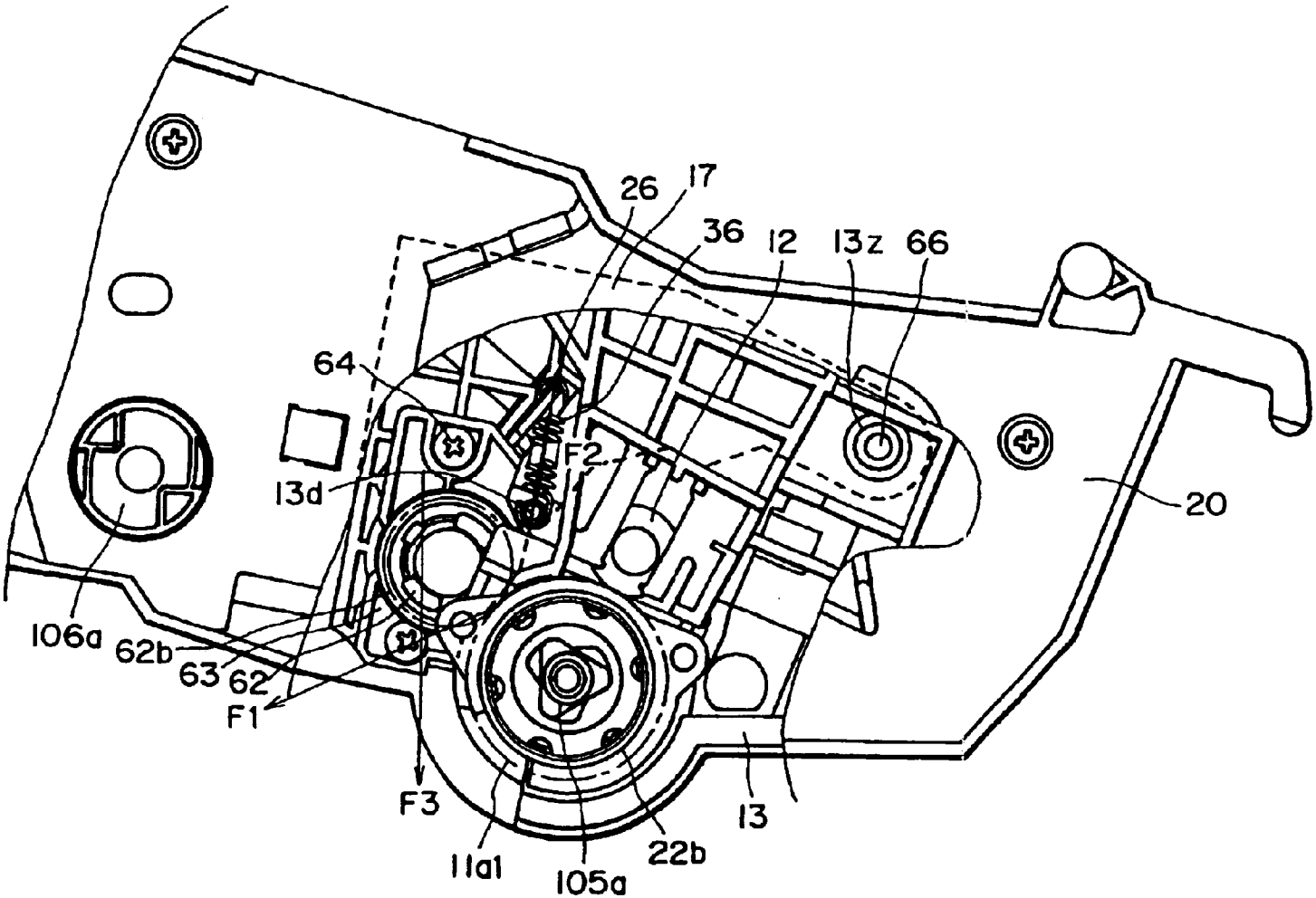
FIG. 22 is a rear view of the structure for connecting the developing apparatus and cleaning means holding frame.
Figure 23:
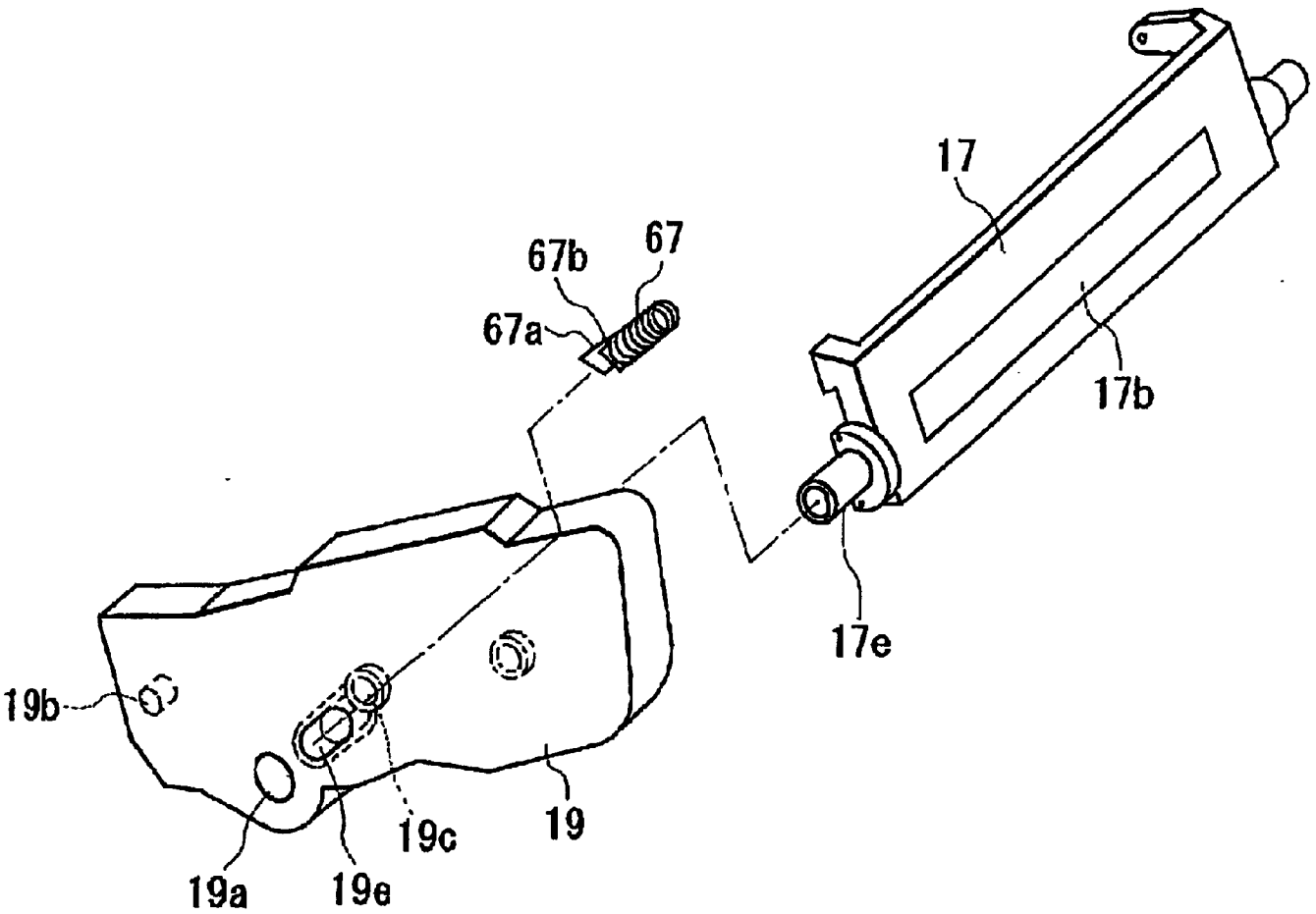
FIG. 23 is an exploded perspective view of the developing means holding frame and side cover, for showing their relationship.

Next, referring to FIGS. 7, 20, 21, 22, and 23, the structure for supporting the developing apparatus will be described. FIG. 20 is a perspective view of the developing apparatus, on the driven side, before the developing apparatus is supported by the cleaning means holding frame 13. FIG. 21 is a perspective view of the developing apparatus, on the driven side, after the developing apparatus is supported by the cleaning means holding frame 13. FIG. 22 is a partially enlarged side view of the driving apparatus, on the driven side, with the side cover removed. FIG. 23 is a perspective view of the developing means holding frame and end cover, on the non-driven side, before the side cover is attached to the developing means holding frame.

As described before, in order to output an image of optimum quality, an optimum SD gap (a gap between the photosensitive drum 11 and the development roller 18) must be kept between the development roller 18 and photosensitive drum 1*l*. For this purpose, in this embodiment, the development roller 18 is pressed upon the photosensitive drum 11 with the application of an optimum amount of pressure (which hereinafter will be referred to as D pressure) to maintain the SD gap (FIG. 2). In this embodiment, this optimum amount of the D pressure is approximately 500 g–2,000 g on both the driven and non-driven sides. If the D pressure is no more than the amount within this range, the SD gap tends to widen due to vibrations or the like, and image defects such as unwanted white spots or the like occur. If the D pressure is no less than the amount within this range, the spacer ring 18*b* is collapsed by the D pressure, allowing the SD gap to narrow. Further, it is possible that, with the elapse of time, the spacer ring 18*b* is shaved due to the load exerted upon the peripheral surface and internal surfaces of the spacer rings 18*b*, or like damage occurs to the spacer rings 18*b*, failing to maintain the optimum amount of the SD gap. In this embodiment, the following structural arrangement is employed to maintain the optimum amount of SD gap. Hereafter, the supporting of the developing apparatus (method for maintaining the SD gap) will be separately described for the driven side and non-driven side.

Referring to FIGS. 20, 21, and 22, on the driven side, the developing means holding frame 17 (the developing apparatus inclusive of the development roller, the development blade, and the like) and the cleaning means holding frame 13 are positioned relative to each other so that the suspension hole 17*d* located in the end portion of the arm portion 17*c* of the developing means holding frame 17 aligns with the support hole 13*z* of the cleaning means holding frame 13, and a parallel pin 66 is inserted through the suspension hole 17*d* and the support hole 13*z*. As a result, the developing means holding frame 17 and the cleaning means holding frame 13 are connected, being enabled to pivot relative to each other about the parallel pin 66 in such a manner that the axial line of the development roller 18 moves toward the axial line of the photosensitive drum 11. Referring to FIG. 22, with this structural arrangement, the amount of the pressure by which the development roller 18 is pressed upon the photosensitive drum 11, on the driven side, is the combination of three forces: a working pressure F1 (the load exerted at the pitch point between the gear portions 11*a*1 and 62*b* in the direction of the transverse line of action upon a gear tooth) between the gear portion 11*a*1 of the flange 11*a* of the photosensitive drum 11 and the gear portion 62*b* of a development roller gear 62; a force F2 generated by the resiliency of the tension coil spring 36 stretched between the cleaning means holding frame 13 and the developing apparatus; and a force F3 which is applied to the center of gravity of the developing apparatus due to the weight of the developing apparatus. In other words, the structural arrangement is such that all three forces work in the direction to pivot the developing apparatus about the parallel pin 66 (pivotal center) in the counterclockwise direction so that the development roller 18 is pressed upon the photosensitive drum 11. Further, the structural arrangement is made so that the angle which the line connecting the contact point between the photosensitive drum 11 and spacer ring 18*b*, and the pivotal center (66) forms relative to the transverse line of action of the force F1, becomes small, for example, approximately 5°. This is due to the following reason. That is, the working pressure F1 fluctuates due to the fluctuation of torque, and the fluctuation of the working pressure F1 results in the fluctuation of the D pressure. Therefore, the above described structural arrangement is made to prevent the fluctuation of the D pressure. Further, the force F3 resulting from the weight of the developing apparatus is stable because the structural arrangement is such that the load from the developer is not exerted upon the developing apparatus D as described before. Further, the tension spring 36 is positioned and supported, as will be described later, so that the resiliency of the spring 36 is not wasted. Therefore, the force F2 is stable. Thus, the D pressure D1 on the driven side remains constant in numerical value.

Referring to FIG. 20, the tension coil spring 36 is approximately 0.5–1 mm in wire diameter. It has hook portions 36*a* and 36*b* at its ends, which are used for anchoring it. As for the material for the tension coil spring 36, springy material such as SUS, piano wire, phosphor bronze, or the like, is used. One of the hooks, for example, a hook 36*a*, is anchored through the hole 26*g* formed in the metallic plate 26*a* of the development blade 26, and the other hook, or the hook 36*b*, is hung around a shaft-like spring mount 13*d* of the cleaning means holding frame 13. The hole 26*g* of the development blade 26 is in the portion of the metallic plate 26*a*, which projects outward from the developing means holding frame 17. It is 2–5 mm in width and 4–8 mm in length. The spring mount 13*d* of the cleaning means holding frame 13 is located in the adjacencies of the photosensitive drum 11, and is 2–5 mm in diameter. It is an integral part of the cleaning means holding frame 13. The hole 26*g* and spring mount 13*d* are positioned so that the line connecting the hole 26*g* of the development blade metallic plate 26*a* and the spring mount 13*d* of the cleaning means holding frame 13, becomes approximately perpendicular to the line connecting the hole 26*g* and the pivotal center (66). The tension coil spring 36 is hooked to the development blade 26, eliminating the need for providing the developing means holding frame 17 with a spring mounting portion in the form of a shaft, for example, which projects outward from the developing means holding frame 17. Therefore, the developing means holding frame 17 can be simple in the configuration of its end surfaces in terms of the longitudinal direction, which in turn makes it easier to set up a jig for attaching the seal 21 to the developing means holding frame 17, improving assembly efficiency. Further, anchoring the tension coil spring 36 to the development blade 26 means anchoring the tension coil spring 36 to a metallic component, which is high in elastic modulus, eliminating the problem that the D pressure is reduced due to the deformation or the like of the spring anchoring portion caused by the resiliency of the tension coil spring 36. Incidentally, when providing the spring anchoring portion, for example, a joggle, as an integral part of the developing means holding frame 17, such a spring anchoring portion must be rendered large enough to prevent the D pressure from being reduced by its deformation. However, in this embodiment, the developing means holding frame 17 does not need to be provided with such a spring anchoring portion, or a joggle, and therefore, contributes to size reduction.

Next, referring to FIG. 23, on the non-driven side of the developing means holding frame 17, the developing means holding frame 17 is provided with projection 17*e*, which projects outward from the developing means holding frame 17, and the axial line of which will align with that of the development roller 18. The developing means holding frame 17 is structured so that this projection 17*e* is pressed toward the center of the photosensitive drum 11. The projection 17*e* has a bearing, as an integral part of the projection, for supporting the non-driven end of the development roller 18.

Next, the structure for maintaining the D pressure on the non-driven side will be described. Referring to FIGS. 7 and 23, to the non-driven end of the developing means holding frame 17, the projection 17*e* is fixed, the axial line of which will be in alignment with the axial line of the development roller 18. The developing means holding frame 17 is structured so that this projection 17*e* is pressed toward the photosensitive drum 11. The projection 17*e* is screwed to the developing means holding frame 17. Referring to FIG. 23, it is inserted into the groove 19*e* (which in this embodiment is an elongated hole, the long axis of which is approximately parallel to the line connecting the axial lines of the development roller 18 and the photosensitive drum 11) of the side cover 19, being enabled to move in the direction of the line connecting the axial lines of the development roller 18 and the photosensitive drum 11. In the groove 19*e*, an elastic member 67 is placed on the side opposite to the photosensitive drum 11, with the projection 17*e* fitted in the groove 19*e* on the photosensitive drum 11 side, in a manner to sandwich the projection 17*e* and press the projection 17*e* by the pressing portion 67*a*. The elastic member 67 is a compression coil spring, the wire diameter of which is approximately 0.5–1.0 mm. The resiliency of this spring generates a pressure D2 which presses the non-driven end of the development roller 18 upon the photosensitive drum 11. In other words, the amount of the pressure D2 is determined by the resiliency of the coil spring alone, and therefore, is stable. This groove 19*e* also functions to as a positioning groove, playing a role in regulating the direction in which the development roller 18 moves. As seen from the inward side of the side cover 19, the groove 19*e* is narrower on the outward side, preventing the pressing portion 67*a* from dislodging outward from the groove 19*e*.

The pressing portion 67*a* is between the elastic member 67 and projection 17*e*. The flat surface 67*b* of the pressing portion 67*a* is in contact with the elastic member 67. The flat surface 67*b* is perpendicular to the direction in which the elastic member 67 exerts pressure. The surface of the pressing portion 67*a*, which is on the opposite side of the portion of the pressing portion 67*a*, on which the flat surface 67*b* is, is a flat surface, and is in contact with the flat portion 17*e*1 of the projection 17*e*.

(Description of Coupling Member)

Next, referring to FIGS. 24–26, the configurations of the coupling members will be described.

Figure 24:
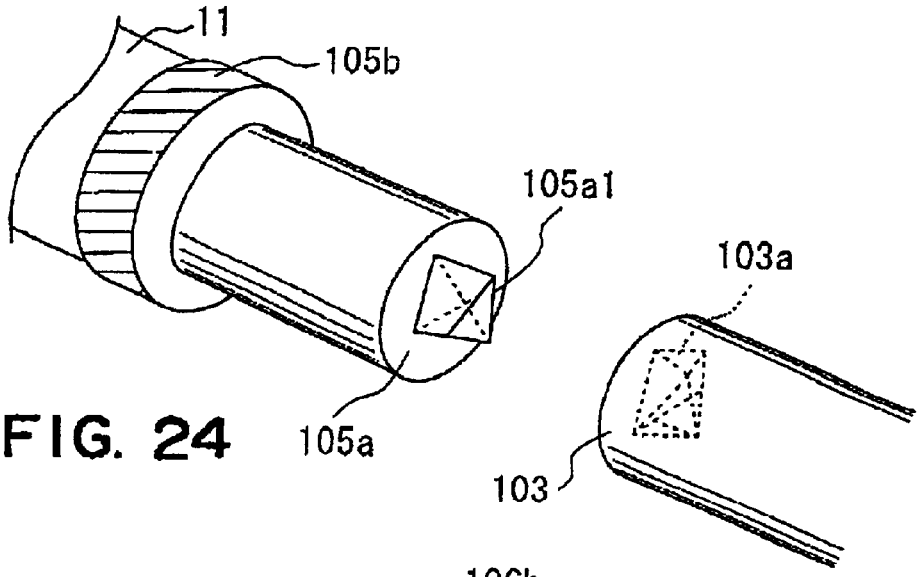
FIG. 24 is a perspective view of the couplings for driving the photosensitive drum.

Referring to FIG. 24, a first coupling 105*a* of the process cartridge 15 has a projection 105*a*1 which is approximately triangular in cross section. More specifically, the projection

105*a*1 is in the form of a triangular pillar twisted about its axial line in the direction in which it is rotated. A first coupling 103, that is, the coupling on the apparatus main assembly side, has a hole 103*a* which is approximately triangular in cross section, and is twisted about its axial line in the direction in which the first coupling 103 is rotated. The first coupling 105*a* engages into the first coupling 103. With the provision of the above described structural arrangement, as the first coupling 103 on the apparatus main assembly side is rotated after the first coupling 105*a* on the process cartridge side and first coupling 103 on the apparatus main assembly side are engaged, the two couplings 103 and 105*a* rotate in such a manner that the edges of the projection 105*a*1 simultaneously make contact with the corresponding walls of the hole 103*a*. As a result, the axial lines of the first coupling 103 on the apparatus main assembly side and the first coupling 105*a* on the process cartridge side become aligned, and therefore, the driving force is smoothly transmitted.

As described above, the first coupling 105*a* and main assembly first coupling 103 are a projection and a hole, respectively, which are in the form of a twisted triangular pillar, and therefore, as they rotate in engagement with each other, thrust is generated in the direction to pull them toward each other in their axial directions.

Figure 25:
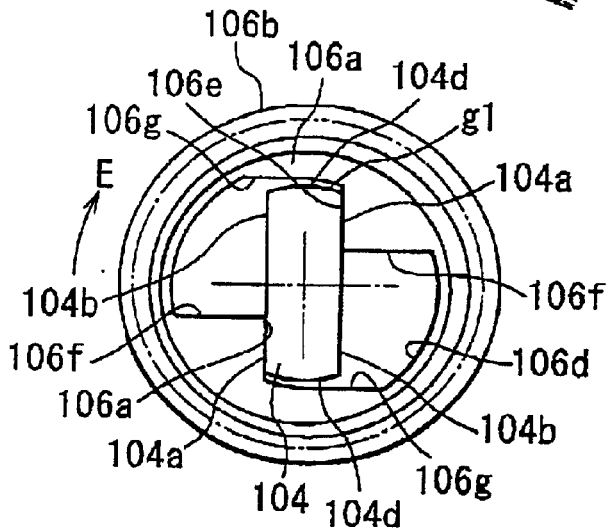
FIG. 25 is a rear view of the couplings for driving stirring members.
Figure 26:
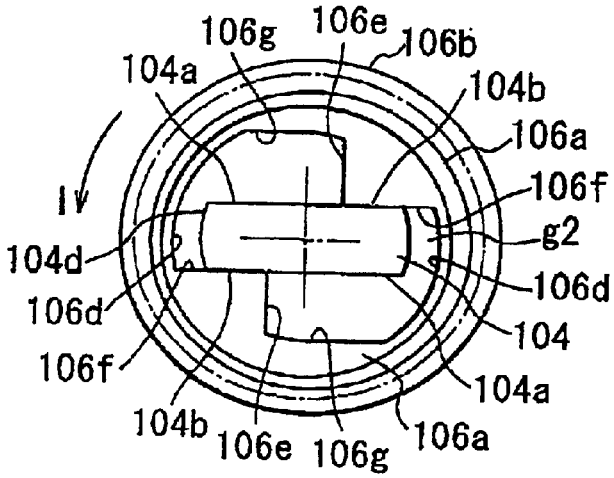
FIG. 26 is a rear view of the couplings for driving stirring members.

Referring to FIGS. 25 and 26, a second coupling 104 on the main assembly side of the image forming apparatus has a portion with two parallel flat surfaces formed by flatting the cylindrical portion, and each flat surface has areas 104*a* and 104*b*. In other words, both ends of each flat surface, in terms of the direction perpendicular to the longitudinal direction, constitute the contact area. On the other hand, each end of the portion with the two parallel flat surfaces, in terms of the direction perpendicular to the longitudinal direction, has two different contact areas: contact area 104*a* and contact area 104*b*. The second coupling 106*a* on the process cartridge side has a hole 106*d*, in which a pair of triangular ribs are placed on the wall of the hole in such a manner that the pair of triangular ribs become symmetrical with respect to the axial line of the hole 106*d* and extend in the axial direction of the hole 106*d*. The side surfaces of each rib are perpendicular to each other and have contact areas 106*e* and 106*f*, respectively.

Referring to FIG. 25, as the second coupling 104 on the main assembly side is rotated in the direction indicated by an arrow mark E, that is, the direction in which the toner seal 24 is opened by an unshown automatic seal opening mechanism, the contact area 104*a* of the second coupling 104 on the main assembly side contacts the contact area 106*e* of the triangular rib of the second coupling 106*a* on the process cartridge side, and transmits a driving force to the second coupling 106*a* on the process cartridge side.

In order to reduce the gaps g1 between the peripheral surface 104*d* of the second coupling 104 on the main assembly side, and the wall of the hole 106*d* of the second coupling 106*a* on the process cartridge side, the wall of the hole 106*d* has been modified in shape to change the distance between the opposing two points on the wall, with respect to the axial line of the hole 106*d*, providing the wall of the hole 106*d* with a pair of surfaces 106*g* approximately parallel to the side surfaces 106*f*.

The peripheral surface of the second coupling 104 on the main assembly side has a cylindrical curvature, and the axial line of this curvature coincides with the rotational axis of the coupling 104 on the main assembly side. Referring to FIG. 26, as the driving for opening the toner seal 24 is completed, the second coupling 104 on the main assembly side rotates in reverse, that is, in the direction indicated by an arrow mark I. As a result, the contact areas 104*b* of the second coupling 104 on the main assembly side come into contact with the contact areas 106*f* of the second coupling 106*a* on the process cartridge side, and drive the second coupling 106*a* on the process cartridge side, transmitting the driving force to the toner stirring members 113, 114, and 123, and the like. During this period, a gap g2 is maintained between the second coupling 104 on the main assembly side and the second coupling 106*a* on the process cartridge side, in terms of their radius directions. In this embodiment, the size of the gap g2 is approximately 2 mm.

With the provision of the above described structural arrangement, while the toner seal 24 is opened, the photosensitive drum 11 is not driven, and the second coupling 104 on the main assembly side and the second coupling 106*a* on the process cartridge side are aligned with each other. Then, after the opening of the toner seal 24, in other words, during image formation, the first coupling 105*a* attached to the photosensitive drum 11, and the first coupling 103 on the main assembly side, remain aligned with each other. During this period, if the second coupling 106*a* on the process cartridge side and the second coupling 104 on the main assembly side, which transmit the driving force to the toner stirring members 113, 114, and 123, and the like, happen to become misaligned, they do not become aligned any more, that is, they remain misaligned, but continue to transmit the driving force. In other words, the second coupling 106*a* on the process cartridge side and the second coupling 104 on the main assembly side are structured not to interfere with the alignment between the first coupling 103 on the main assembly side and the first coupling 105*a* on the process cartridge side.

(Description of Driving System)

Figure 27:
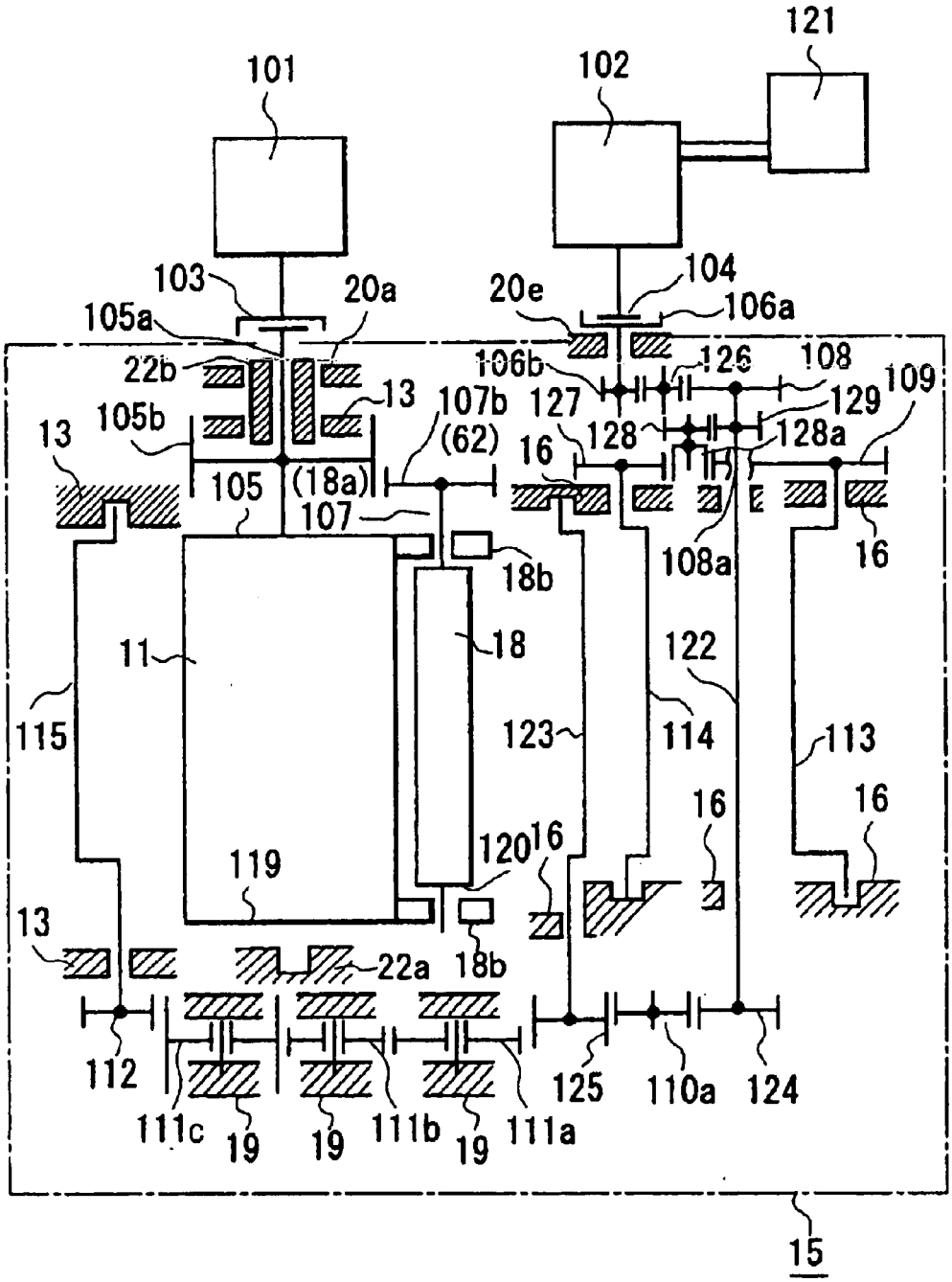
FIG. 27 is a diagram of the system for driving the process cartridge.
Figure 36:
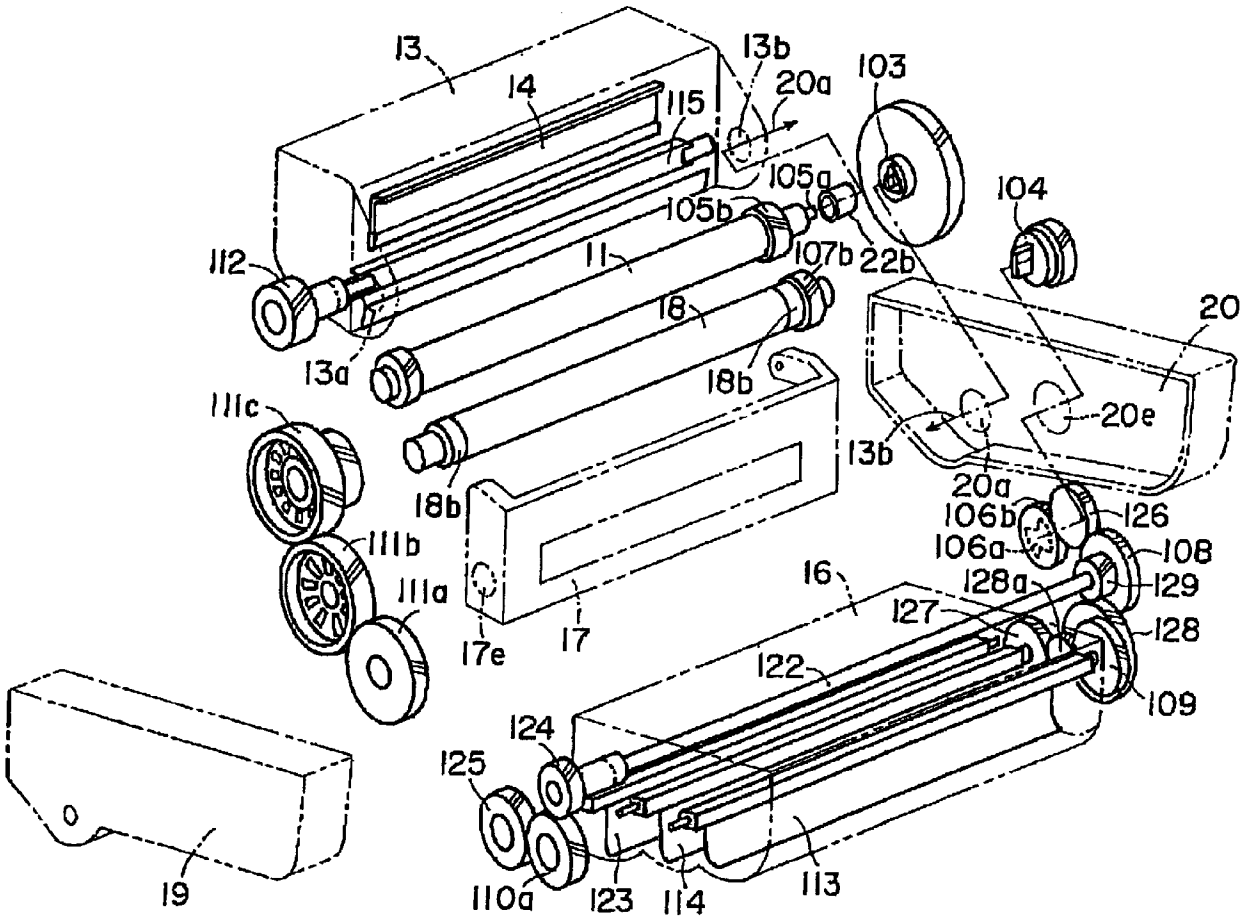
FIG. 36 is an exploded perspective view of the driving system of a process cartridge.

FIG. 27 is a system diagram of the drive train in this embodiment. FIG. 36 is an exploded perspective view of the drive train in this embodiment, for describing the positioning of the drive train.

Driving force sources 101 and 102, for example, motors, provided on the apparatus main assembly 27 side to drive the process cartridge 15, have couplings 103 and 104, respectively. With the process cartridge 15 mounted in the apparatus main assembly 27, the couplings 103 and 104, and power sources 101 and 102 are in connection with the couplings 105*a* and 106*a*, which rotate with the input gears 105*b* and 106*b*, respectively, on the process cartridge side. The input gear 106*b* is also called a power input gear. The coupling 106*a* is supported by a bearing 20*e*. The coupling 105*a* and gear 105*b* are integral parts of a gear flange 105, and are supported by the cleaning means holding frame 13, with the interposition of the bearing 22*b*. Incidentally, it is possible to provide the system for driving the toner stirring members with the driving force source 102 independent from the driving force source 101 for driving the photosensitive drum 11, so that the rotational velocity of the motor 102 can be varied with the provision of a controlling apparatus 121 to vary the velocity at which the toner stirring member driving system is driven.

The controlling apparatus 121 is enabled to turn on or off the driving force source. 102, or vary the driving speed, according to such factors as the cumulative number of copies the process cartridge 15 has produced, the amount of the toner within the process cartridge 15, the torque necessary to drive the stirring members of the process cartridge 15, and the like, that reflect the condition of the process cartridge 15.

With the provision of the driving force source 102 independent from the driving force source 101 for the photosensitive drum 11, even when the speeds of the photosensitive drum 11 and the development roller 18 in the apparatus main assembly 27, which are enabled to print at high speed, are increased, the stirring speed can be kept unchanged by keeping the driving speed of the driving force source 102 unchanged, in other words, by setting the driving speed of the driving force source 102 independent from the driving force source 101 for driving the photosensitive drum 11 and the development roller 18. The driving force source 102 may be eliminated. In such a case, the force for driving the stirring system is drawn from the driving force source 101 with the interposition of a speed varying apparatus between the stirring system and the driving force source 101, so that an optimum speed can be set for the stirring system by varying the driving speed at which the stirring system is driven by the driving force source 101 in accordance with the operational mode of the apparatus main assembly 27.

Next, the driving system on the process cartridge side will be described.

The photosensitive drum 11 and the development roller 18, which are directly involved in the development of an electrostatic latent image, are provided with gear flanges 105 and 107, which are fixed to the ends of the photosensitive drum 11 and development roller 18, respectively. The gear flanges 105 and 107 comprise gears 105*b* and 107*b*, which are integrally formed with the gear flanges 105 and 107, respectively. To the other ends of the photosensitive drum 11 and the development roller 18, bearing flanges 119 and 120 are fixed. The photosensitive drum 11, the gear flange 105, and the bearing flange 119 together constitute a photosensitive drum unit, and the development roller 18, the gear flange 107, and the bearing flange together constitute a development roller unit. The gear 105*b* and the sleeve gear 107*b* are meshed with each other.

As the coupling 103 is rotated by the driving force source 101 on the apparatus main assembly 27 side, the photosensitive drum 11 and the development roller 18 rotate. The photosensitive drum unit is rotationally supported by the bearing members 22*a* and 22*b*. The development roller 18, which is fitted with the pair of spacer rings 18*b* which are larger in external diameter than the development roller 18 and are coaxial with the development roller 18, rotate while pressing the spacer rings 18*b* upon the peripheral surface of the photosensitive drum 11. Therefore, the photosensitive drum 11 and the development roller 18 rotate while maintaining an optimum gap between their peripheral surfaces. The bearing members 22*a* and 22*b* are walls themselves of the holes provided in the walls of the cleaning means holding frame 13 of the process cartridge 15, or members (FIG. 7) fixed to the cleaning means holding frame 13. In the bearing members 22*a* and 22*b*, the journal portions of the flanges 105 and 119 fit, respectively.

In the drive trains for the stirring system, the driving force is transmitted to an idler gear 108 meshed with an idler gear 126, which is meshed with an input gear 106*b*, and then, is transmitted to an idler gear 129 fixed to a shaft 108*a* to which the idler gear 108, which is also called a power input gear, is fixed. Then, it is transmitted to an idler gear 128 meshed with the idler gear 129. The idler gear 128 is a step gear, the small diameter portion 128*a* of which is meshed with the stirring gears 109 and 127, also called power input gears, to transmit the driving force to the stirring members 113 and 114. The axial line of the input gear 106*b* does not need to be in alignment with the axial line of the stirring member 114, and therefore, the range in which the input gear 106*b* must be positioned is relatively wide. The aforementioned gears in the process cartridge 15 are all rotationally supported by the frame of the process cartridge 15.

The shaft 108*a* of the idler gear 108 is integral with a driving force transmitting rod 122, also called a driving power transmitting rod 122, or connected thereto in alignment therewith. The driving force transmitting rod 122 is connected to an idler gear 124, on the opposite side of the process cartridge 15 in terms of the longitudinal direction, and transmits the driving force to the stirring member 123 through a stirring gear 125 meshed with an idler gear 110*a*. The driving force transmitting rod 122, and stirring members 113, 114, and 123, are rotationally supported by the toner container 16.

Thus, as the input gear 106*b* rotates, the stirring members 114, 113, and 123, and the driving force transmitting rod 122, also rotate because the journal portions of those components are rotationally supported by the bearings with which the toner container 16 is provided.

Referring to FIG. 24, the projection 105*a*1, in the form of a twisted triangular pillar, of the coupling 103 of the drum flange 105 engages into the hole 103*a*, in the form of a twisted triangular pillar, on the apparatus main assembly 27 side, and as the coupling 103 is driven, thrust is generated in the direction to pull the projection 105*a*1 into the hole 103*a*, and the couplings 103 and 105*a* are aligned with each other. Thus, as the coupling 103 is driven, the position of the process cartridge 15 relative to the apparatus main assembly 27 in terms of the longitudinal direction is determined. The projection of the coupling 104 and the hole of the coupling 106*a* are constructed to provide a certain amount of a gap between the projection and the wall of the hole in terms of their radius directions, to afford a certain amount of misalignment between the coupling 104 and coupling 106*a*. Therefore, the engagement between the coupling 104 and coupling 106*a* does not affect the positioning of the first coupling 105*a* on the drum flange side (FIGS. 25, 26, and 36). In order to control the rotation of the process cartridge 15, the positions of the projections of the rotation controlling portions 19*g* and 20*g* of the side covers 19 and 20, respectively, are fixed by the apparatus main assembly 27. In other words, the couplings on the side where the driving force is transmitted to the photosensitive drum 11 for latent image formation, and the development roller 18 for latent image development, which directly affect image formation, are precisely structured so that the process cartridge 15, more specifically, the photosensitive drum 11 and development roller 18, are accurately positioned relative to the apparatus main assembly 27 by the aligning functions of the couplings. However, the couplings on the side where the driving force is transmitted to the stirring system, are roughly structured so that they engage for the sole purpose of transmitting the driving force.

Within the cleaning means holding frame 13, which doubles as the removed toner bin 5, the feather-like removed toner moving member 115 for conveying the toner removed from the photosensitive drum 11 is placed. The removed toner moving member 115 is rotationally supported by the cleaning means holding frame 13; the shaft of the removed toner moving member 115 is supported by the bearings with which the cleaning means holding frame 13 is provided. To one end of the removed toner moving member 115, a power input gear 112 is fixed, which is connected to the gear 124 through idler gears 111*c*, 111*b*, and 111*a*, stirring gear 125, and idler gear 10*a*. To the end of the driving power transmitting rod 122, on the side opposite to the end to which the gear 108, or also called the power input gear, is fixed, in other words, on the non-driven side, the gear 124, or a power output gear, is fixed. The idler gears 111*a*, 111*b*, and 111*c* are rotationally supported by the side cover 19; their shafts are supported by the bearings with which the side cover 19 is provided. As the driving force transmitting rod 122 rotates, the removed toner moving member 115 is rotated by the rotation of the driving force transmitting rod 122. The shafts which support idler gears 111*a*, 111*b*, and 111*c*, one for one, are non-rotational shafts and are integrally formed parts of the side cover 19.

The idler gear 111*c* may be replaced with a step gear so that the large diameter portion of the step gear is meshed with the idler gear 111*b*, and the small diameter portion of the step gear is meshed with the removed toner moving member 115.

As described above, the process cartridge 15 essentially comprises two drive trains: the drive train for driving the photosensitive drum 11 and the development roller 18, and the drive train for driving the stirring members, and the removed toner moving member. The two drive trains are independently driven by the driving force sources on the apparatus main assembly 27 side.

The drive trains may be structured so that the removed toner moving member 115 is driven by the driving force transmitted from the opposite side of the toner container 16, that is, the side opposite to the side from which the driving force is transmitted to the stirring members 113 or 114, or by the driving force transmitted from any of the power input gears 106*b*, 109, and 127, and idler gears 108 and 128, with the interposition of a dedicated gear train.

(Structure of Cooling Air Passage)

Figure 28:
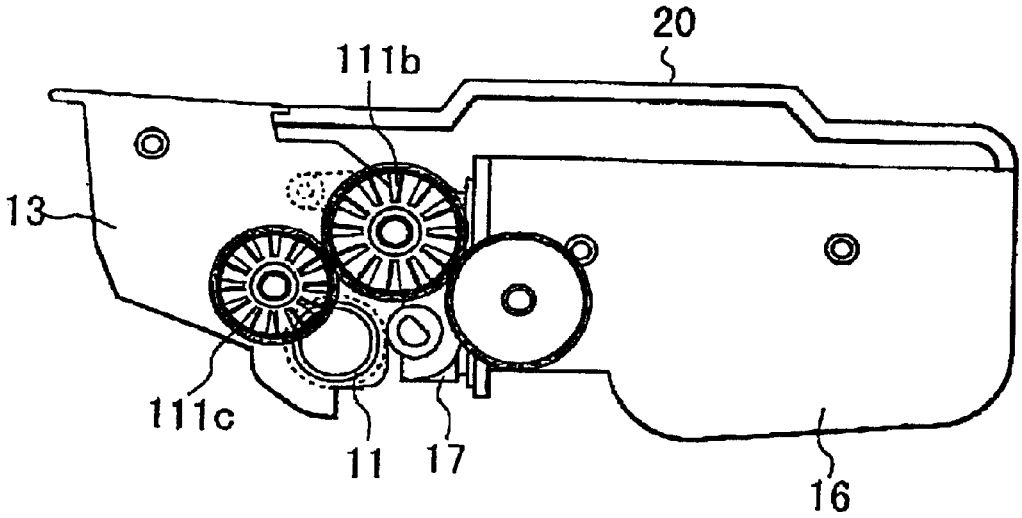
FIG. 28 is a front view of a cooling means of the process cartridge.
Figure 29:
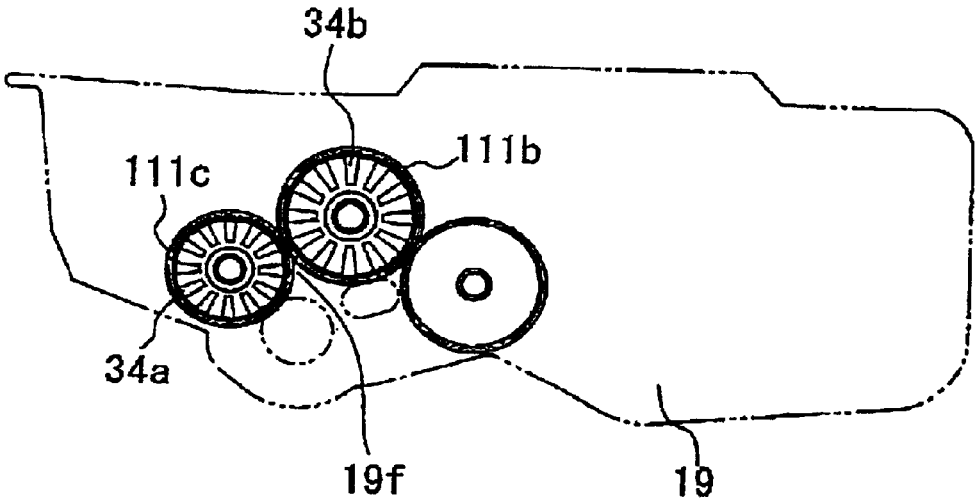
FIG. 29 is a front view of the cooling means of the process cartridge.

FIGS. 28 and 29 are drawings of a typical gear train positioned in the adjacencies of the photosensitive drum 11. FIG. 28 is a side view of the process cartridge 15 with the side cover removed, whereas FIG. 29 is a side view of the process cartridge 15 with the contour of the side cover indicated by a double-dot chain line. Within the cleaning means holding frame 13, the removed toner moving member 115 for conveying the recovered removed toner, inward of the removed toner bin 5, is placed. In order for the removed toner moving member 115 to be driven by the photosensitive drum 11, the driving speed must be drastically reduced in some cases. However, when a structural arrangement is made so that the removed toner moving member 115 is driven by the toner stirring member 114 within the toner container 16, the drastic speed reduction is unnecessary, making it easier to provide the removed toner moving member 115 with a proper driving speed. In such a case, the gears 111*b* and 111*c* are positioned in the adjacencies of the photosensitive drum 11 and outside the toner container 16 and the developing means holding frame 17 (FIG. 28).

In this embodiment, in order to prevent a temperature increase in the adjacencies of the photosensitive drum 11, the side cover 19 is provided with an air passage 19*f* (FIG. 29), which is located in the adjacencies of the photosensitive drum 11. However, the air passage 19*f* for cooling the interior of the process cartridge 15 is blocked by the gears 111*b* and 111*c* of the gear train. Thus, the gears 111*b* and 111*c* are provided with slits 34*a* and 34*b*, which are cut in a manner to constitute an axial flow fan to forcefully take in or exhaust air through the air passage 19*f*.

Figure 30:
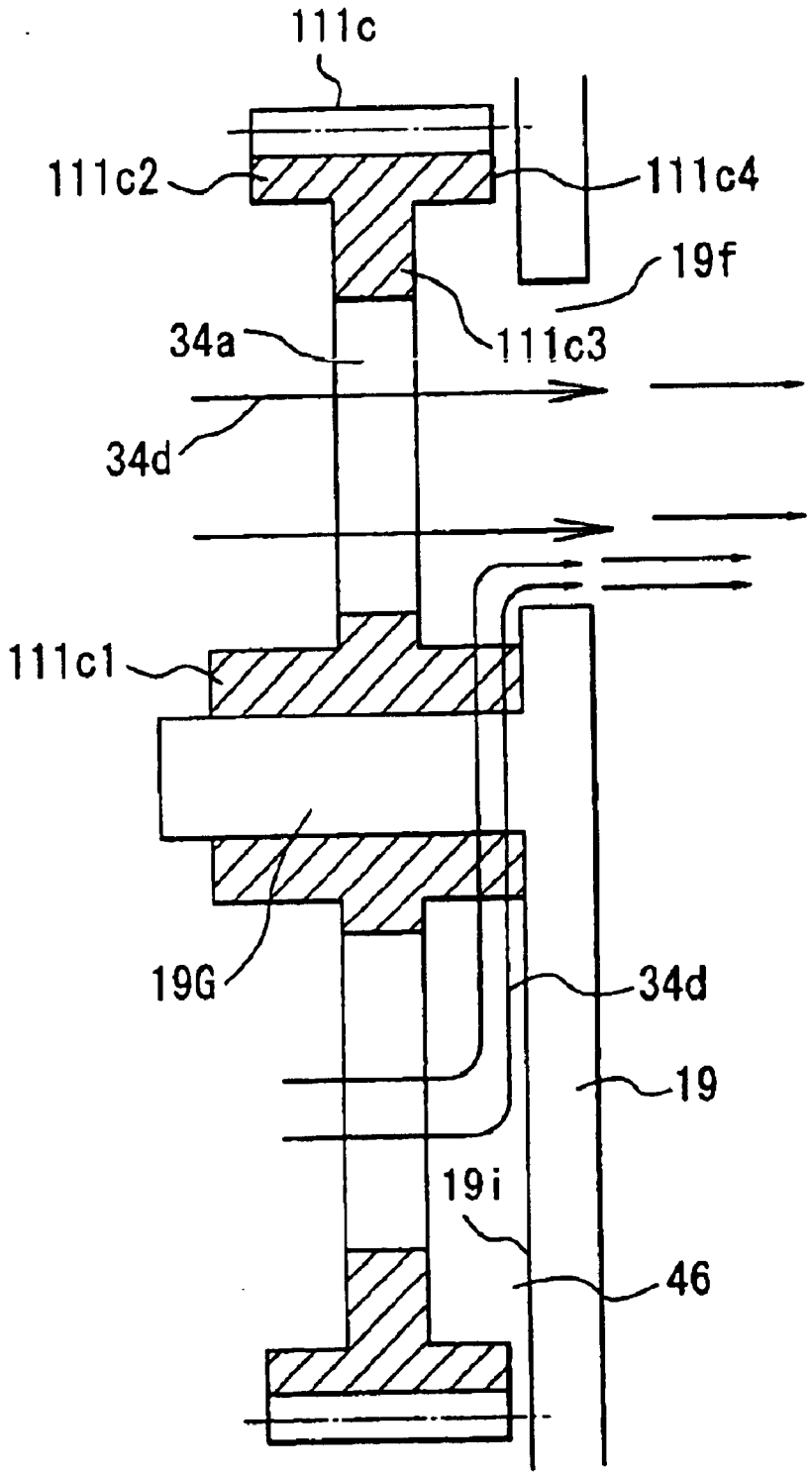
FIG. 30 is a sectional view of a gear with an impeller at a plane A—A in FIG. 31.
Figure 31:
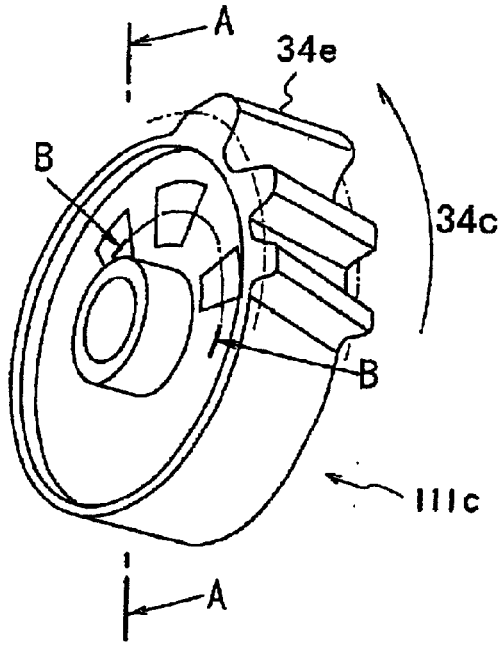
FIG. 31 is a perspective view of the gear with an impeller.
Figure 32:
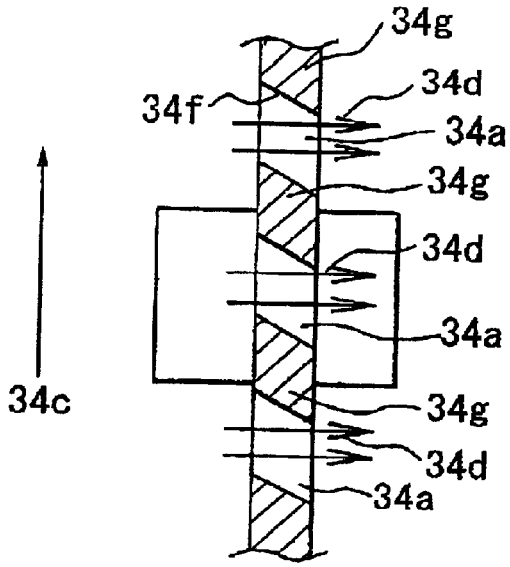
FIG. 32 is a perspective view of the gear with an impeller at a plane B—B in FIG. 31.
Figure 33:
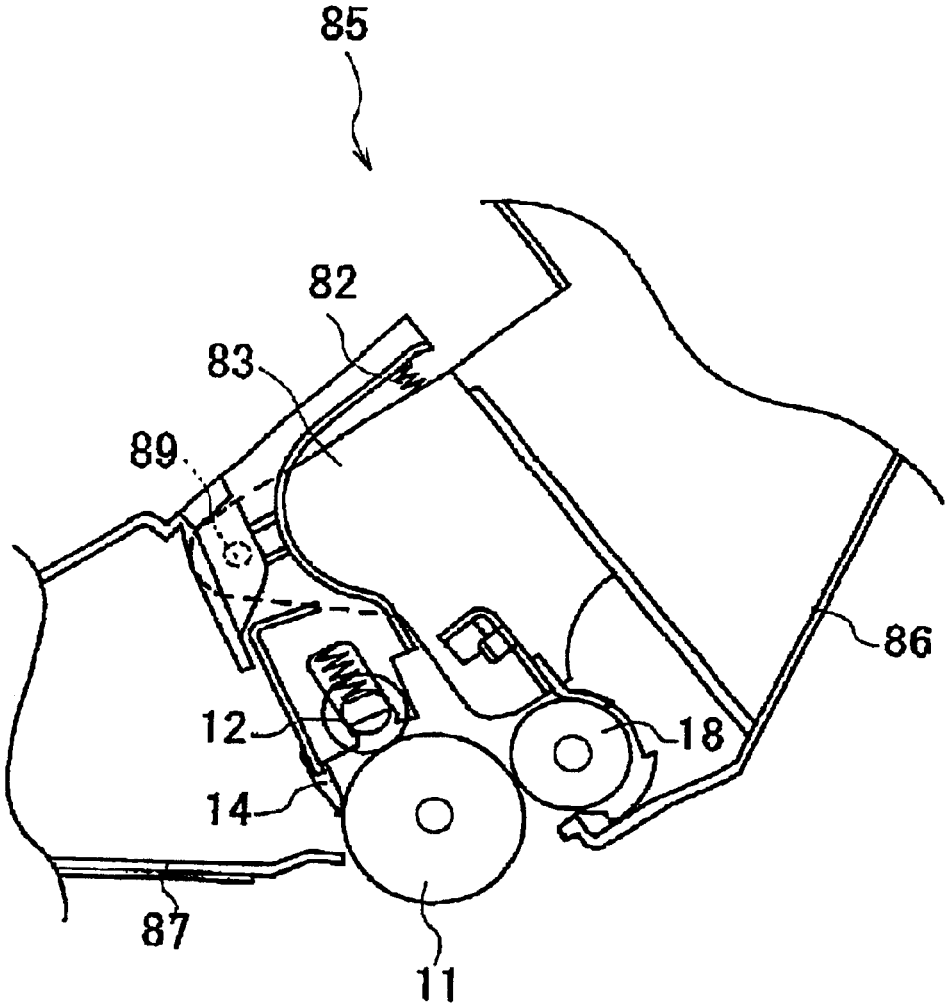
PRIOR ART FIG. 33
FIG. 33 is a vertical sectional view of an example of a conventional process cartridge.

Next, referring to FIGS. 30, 31, and 32, the structure of the cooling air passage will be described. FIG. 31 is a perspective view of the gear 111*c*. The gear 111*b* is the same as the gear 111*c* except that they are different in both the direction in which the teeth are twisted and the direction in which the air passage is twisted. Therefore, the structure of the cooling air passage will be described with reference to only the gear 111*c*. FIG. 32 is a view of the gear 111*c*at a plane B—B in FIG. 31, and FIG. 30 is a sectional view of the gear 111*c* at a plane A—A in FIG. 31.

The gear 111*c* is a helical gear comprising a rim 111*c*2, a boss 111*c*1, and a disk-shaped hub 111*c*3. The hub 111*c*3 has a plurality of slits 34*a*, which radially extend, being evenly distributed in terms of the circumferential direction. There is a gap between the surface of the hub 111*c*3 and the inward surface 19*i* of the side cover 19. Thus, the air passage 19*f* of the side cover 19, which connects the inward and outward sides of the side cover 19, is connected to the slits 34*a* through a space 46. The gear 111*c* is rotationally supported by the shaft 19G, which projects inward from the inward surface of the side cover 19 in the longitudinal direction and is put through the central hole of the boss 111*c*1. The. shaft 19G is fitted with an unshown stopper ring to prevent the gear 111*c* from shifting in the axial direction of the shaft 19G. The lateral surface 111*c*4 of the rim 111*c*2 is positioned as close as possible to the inward surface 19*i* of the side cover 19 to make as small as possible the amount of the air which passes between the surfaces 19*i* and 111*c*4. Incidentally, in order to make as small as possible the amount of the air which passes between the surfaces 19*i* and 111*c*4, these surfaces may be intricately configured in a manner to form a labyrinth.

The slits 34*a* are positioned so that they align with the air passage 19*f* in terms of the radius direction of the gear 111*c*.

Referring to FIG. 32, the portion of the hub 111*c*3, between the adjacent two slits 34*a*, constitutes a helical fan blade 34*g*. In order to improve the air blowing efficiency of the gear 111*c*, each slit 34*a* is desired to be aerodynamically shaped to give the helical fan blade 34*g* such an aerodynamic shape as that of the fan blade of an axial flow fan. However, since the rotational velocity of the gear 111*c* is rather slow, the blade 34*g* may be simply tilted. As the slits 34*a* are cut in the hub 111*c*3 as described above, an impeller is formed on the inward side of the rim 111*c*2 in terms of the radial direction of the rim 111*c*2.

Referring to FIGS. 31 and 32, as the gear 111*c* rotates in the direction indicated by an arrow mark 34*c*, air flows in the axial direction and enters the space 34 as indicated by an arrow mark 34*d* in FIG. 30. Then, the air flows from the space 46 toward the air passage 19*f*, and is exhausted from the process cartridge 15 through the air passage 19*f* of the side cover 19.

Since the space 46 is located so that it faces all the slits 34*a* at the same time regardless of their rotational positions, all fan blades 34*g* contribute to the generation of air flow.

If the direction in which the surface 34*f* of each fan blade 34*g* is tilted is reversed, the direction of the air flow is reversed to send the ambient air of the image forming apparatus into the process cartridge 15, even if the rotational direction of the gear 111*c* is kept the same. The fan blade 34*g* should be tilted in the direction most effective for cooling, in consideration of the component positioning, and the overall structure of the air passage.

Matching the direction in which each tooth 34*e* of the helical gear 111*c* is twisted to the direction in which the surface 34*f* of each fan blade 34*g* is twisted makes the same the directions in which air flow is generated in the axial direction of the gear 111*c* by the helical teeth portion and axial fan portion of the gear 111*c*, and is advantageous when constructing a mold for forming the gear 111*c* using resin. When making a structural arrangement so that the teeth 34*e* and fan blades 34*g* of the gear 111*c* send air in the same direction in terms of the axial direction of the gear 111*c*, a gap should be provided between the lateral surface of the rim 111*c*2 and the inward surface of the side cover 19 to allow air to flow through, and a cover which follows the peripheral surfaces of the gear 111*c*, except for the area across which the gear 111*c* meshes with its counterpart, should be provided as if providing an air blower with a casing.

Since an impeller is provided as a part of the gear 111*c* by cutting the plurality of slits 34*a* in a manner to form the plurality of fan blades 34*g* with the tilted surface 34*f* as described above, and the gears 111*b* and 111*c* rotate when forming images, the internal air of the process cartridge 15, in particular, the air in the adjacencies of the charging portion and cleaning blade, which increases in temperature, is exhausted without becoming stagnant, and also the heat generated by the fixing apparatus or the like is removed. Incidentally, the image forming apparatus main assembly 27 is provided with ventilating means (unshown), for example, air vents through which the internal air of the apparatus main assembly 27 is replaced with the ambient air, naturally, or forcefully with the use of a fan.

(Cartridge Mounting Portion of Apparatus Main Assembly)

Figure 34:
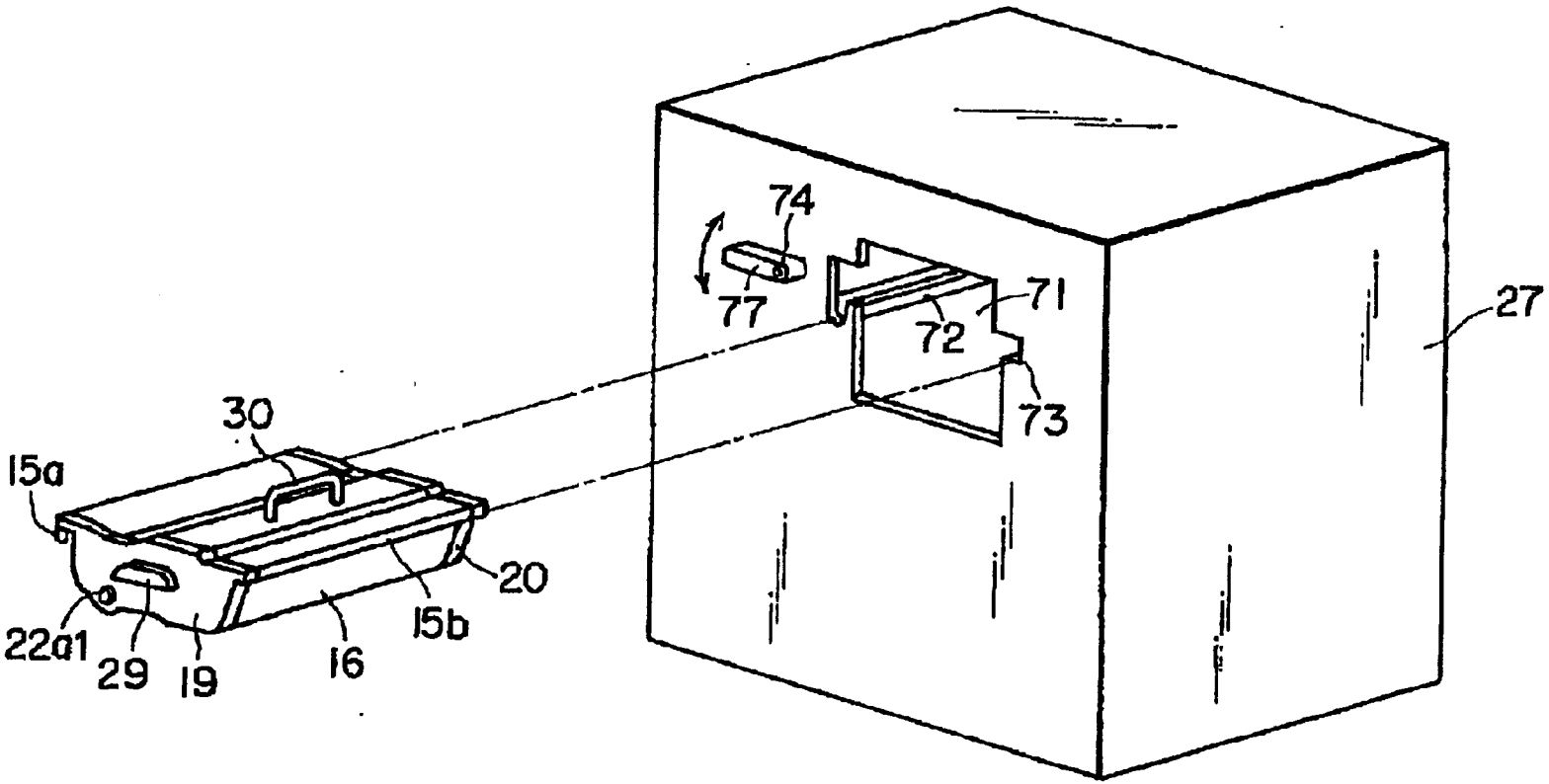
FIG. 34 is a perspective view of a process cartridge and the main assembly of an image forming apparatus, for showing how the process cartridge is mounted into, or dismounted from, the main assembly.

FIG. 34 is a perspective view of the cartridge mounting portion of the apparatus main assembly. Opening the front door (unshown) of the apparatus main assembly 27 exposes the entrance of the cartridge mounting portion 71.

Figure 35:
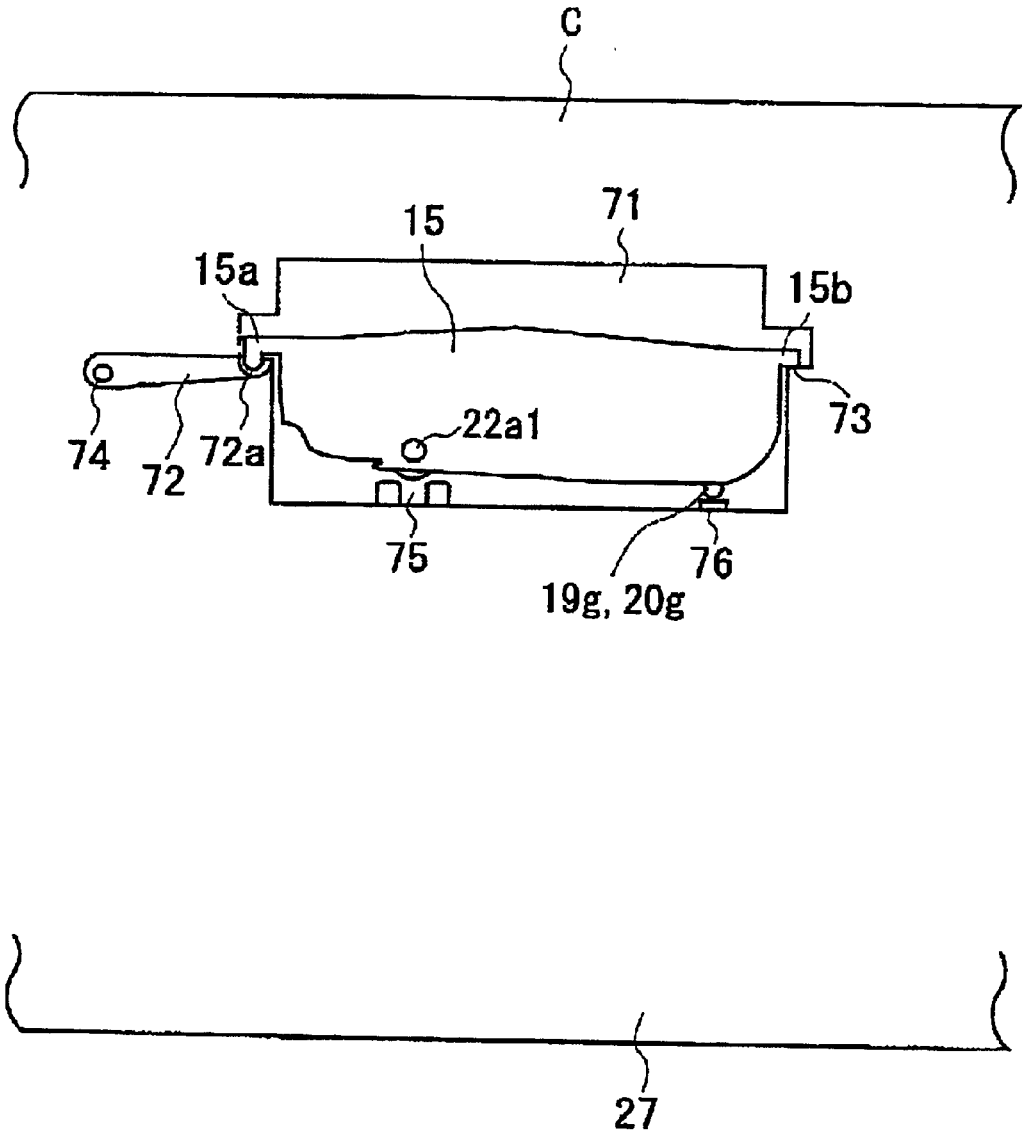
FIG. 35 is a front view of a process cartridge and the main assembly of an image forming apparatus, for showing how the process cartridge is mounted into, or dismounted from, the main assembly.

The cartridge mounting portion 71 is provided with a pair of guide rails 72 and 73, which extend perpendicular to the direction in which the sheet S as a recording medium is conveyed, and in parallel to the surface of the sheet S being conveyed. Referring to FIG. 35, the guide rail 72 is supported by a shaft 74, being allowed to pivot about the axial line of the shaft 74 so that the cartridge supporting surface 72*a* of the guide rail 72 can be moved upward or downward. The guide rail 73 is stationary. The guide rails 72 and 73 are disposed approximately parallel to each other, and at approximately the same level; in other words, they are disposed in virtually the same horizontal plane.

The process cartridge 15 is mounted into, or dismounted from, the apparatus main assembly 27 by being inserted into, or pulling out of, the cartridge mounting portion 71 ink the lengthwise direction of the process cartridge 15, with the guiding portions 15*a* and 15*b* of the process cartridge 15 engaged with the guide rails 72 and 73 of the cartridge mounting portion 71, respectively.

Also referring to FIG. 35, the shaft 74 is rotationally attached to the apparatus main assembly 27. The guide rail 72 is provided with the cartridge supporting surface 72*a*, which is located at the vertically movable end portion of the guide rail 72, extending in the longitudinal direction, and the cross section of which is approximately in the form of an upwardly open semicircle. This cartridge supporting surface 72*a* is configured so that the guide portion 15*a* of the process cartridge 15, the cross section of which is in the form of a downwardly bulging semicircle, snugly fits against the surface 72*a*. Also referring to FIG. 35, the apparatus main assembly 27 is provided with a pair of cartridge rests 76, on which the cartridge rotation regulating portions 19*g* and 20*g* of the cartridge 15, which are on the right-hand side in FIG. 35, rest; as the cartridge guide (guide rail) 72 is rotated clockwise about the shaft 74, the guide portion 15*a* of the process cartridge 15 is lowered, and the cartridge rotation regulating portions 19*g* and 20*g* come into contact with the pair of cartridge rests 76, one for one, resting thereon. Further, the apparatus main assembly 27 is provided with a pair of cartridge positioning grooves 75, in which the shaft 22*a*1 of the bearing member 22*a* and the shaft of the bearing member 22*b*, respectively, (22*b* is on the leading end side of the process cartridge 15 in terms of the cartridge mounting direction, and therefore, does not appear in FIG. 35) snugly fit, one for one. In other words, the position of the process cartridge 15 relative to the apparatus main assembly is fixed by both ends of the process cartridge 15 in terms of the longitudinal direction.

Referring to FIG. 34, the shaft 74 projects frontward of the apparatus main assembly beyond the front panel of the apparatus main assembly, and the frontward end of the shaft 74 is provided with a lever 77.

Unless an external force is applied to the lever 77, the lever 77 is kept at the position shown in FIG. 35, by an unshown stopper, and pressure is applied to the cartridge guide 72 (guide rail) from an unshown spring in the direction to move the cartridge supporting surface 72*a* upward. As the lever 77 is rotated upward against the aforementioned pressure from the unshown spring, the process cartridge 15 pivots downward about the contact point between the process cartridge 15 and the guide rail 73. As a result, the cartridge rotation controlling portions 19*g* and 20*g* (20*g* is on the rear side of the apparatus main assembly) first come into contact with the pair of cartridge rests 76 of the apparatus main assembly 27, one for one. As the lever 72 is lowered further by the further upward rotation of the lever 77, the guide portion 15*b* of the process cartridge 15 becomes separated from the guide rail 73 of the apparatus main assembly 27, and then, the shaft 22*a*1 of the bearing members 22*a* of the process cartridge 15 fits into the cartridge positioning groove 75 of the apparatus main assembly 27, on the front side. As a result, the position of the process cartridge 15 becomes fixed relative to the apparatus main assembly 27. Obviously, the shaft portion of the bearing member 22*b* fits into the groove 75 on the rear side of the apparatus main assembly 27 in the same manner as the shaft 22*a*1 fits into the cartridge positioning groove 75 on the front side. The lever 77 is further lowered to a position at which it is held by an unshown notch or the like.

As for the dismounting of the process cartridge 15 from the apparatus main assembly 27, the above described process cartridge mounting process is carried out in reverse.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus, said process cartridge comprising:

an electrophotographic photosensitive drum;

a developing member configured and positioned to develop an electrostatic latent image formed on said electrophotographic photosensitive drum;

a developer accommodating portion configured and positioned to accommodate a developer to be used for development of the electrostatic latent image by said developing member;

a developer moving member for moving the developer accommodated in said developer accommodating portion toward said developing member;

a cartridge positioning portion configured and positioned to engage a main assembly positioning portion provided in the main assembly of the apparatus to position said process cartridge relative to the main assembly of the apparatus, said cartridge positioning portion being disposed at a developer-accommodating-portion side of said cartridge with respect to a direction crossing a direction of an axis of said electrophotographic photosensitive drum;

a photosensitive drum driving force receiving portion configured and positioned to receive a driving force for rotating said electrophotographic photosensitive drum from the main assembly of the apparatus when said process cartridge is mounted to the main assembly of the apparatus, said photosensitive drum driving force receiving portion being provided on one end of said photosensitive drum and being disposed at a leading side with respect to a direction of mounting said process cartridge to the main assembly of the apparatus, said photosensitive drum driving force receiving portion including a twisted prism having a substantially triangular cross-section and which is engageable with a twisted recess having a substantially triangular cross-section and provided in the main assembly of the apparatus, wherein said process cartridge is mounted to the main assembly of apparatus in the direction of the axis of said electrophotographic photosensitive drum; and a moving member driving force receiving portion configured and positioned to receive a driving force for rotating said developer moving member from the main assembly of the apparatus when said process cartridge is mounted to the main assembly of the apparatus, said moving member driving force receiving portion being disposed at the leading side of said cartridge with respect to the direction of mounting said process cartridge to the main assembly of the apparatus, said moving member driving force receiving portion being operatively engageable with a driving force transmitting member provided in the main assembly of the apparatus irrespective of any eccentricity relative to the driving force transmitting member;

wherein the rotational directions of said photosensitive drum driving force receiving portion and said moving member driving force receiving portion when said photosensitive drum driving force receiving portion and said moving member driving force receiving portion receive driving forces from the main assembly of the apparatus, are the same, wherein the rotational directions are such that a rotation moment is produced so as to contact said cartridge positioning portion to the main assembly positioning portion of the apparatus, and wherein the twisted recess and said twisted prism provide a centering function relative to each other, and said moving member driving force receiving portion receives the driving force for rotating said developer moving member without preventing the centering function between the twisted recess and said twisted prism.

2. A process cartridge according to claim 1, wherein said cartridge positioning portion is constituted by an outside of an outer wall of said process cartridge, and is projected in the mounting direction, and said cartridge positioning portion is disposed at a leading side of said cartridge in the mounting direction.

3. A process cartridge according to claim 1 or 2, wherein said cartridge positioning portion is integral with an end-cover leading side of said cartridge, at which an end cover is disposed, with respect to the direction of mounting said process cartridge to the main assembly of the apparatus, ends of a developing frame supporting said developing member, a developer frame having a said developer accommodating portion, and a drum frame supporting an end of said photosensitive drum, wherein said end cover is provided with a first hole and a second hole, and the driving force for driving said photosensitive drum driving force receiving portion is transmitted from the main assembly of the apparatus to said photosensitive drum driving force receiving portion through said first hole, and the driving force for driving said moving member driving force receiving portion is transmitted from the main assembly of the apparatus to said moving member driving force receiving portion through said second hole.

4. A process cartridge according to claim 3, wherein a leading end surface of said cartridge positioning portion is substantially at the same position as an outer surface of said end cover with respect to the mounting direction.

5. A process cartridge according to claim 1, wherein said developing member comprises a developing roller, wherein said electrophotographic photosensitive drum is rotated by the driving force received by said photosensitive drum driving force receiving portion from the main assembly of the apparatus, and wherein the driving force received by said photosensitive drum driving force receiving portion is transmitted to said developing roller to rotate said developing roller.

6. A process cartridge according to claim 1, wherein said developer moving member includes a first developer moving member and a second developer moving member provided in said developer accommodating portion, and wherein said first developer moving member and said second developer moving member receive, at the same side as a side where said moving member driving force receiving portion is provided with respect to the mounting direction, the driving force which is received by said moving member driving force receiving portion from the main assembly of the apparatus.

7. A process cartridge according to claim 6, wherein said developer moving member further includes a third developer moving member provided in said developer accommodating portion, wherein said third developer moving member is disposed downstream of said first developer moving member and second developer moving member with respect to a developer moving direction, and wherein said third developer moving member receives, at a side opposite from a side where said moving member driving force receiving portion is provided with respect to the mounting direction, the driving force received by said moving member driving force receiving portion from the main assembly of the apparatus.

8. A process cartridge according to claim 7, further comprising a cleaning member configured and positioned to remove a developer remaining on said electrophotographic photosensitive drum, and a developer feeding member configured and positioned to feed the developer removed by said cleaning member into a removed developer accommodating portion, wherein said developer feeding member receives, a side opposite from a side where said moving member driving force receiving portion is provided with respect to the mounting direction, the driving force received by said moving member driving force receiving portion from the main assembly of the apparatus.

9. An electrophotographic image forming apparatus for forming an image on a recording material, to which a process cartridge is detachably mountable, said electrophotographic image forming apparatus comprising:

a mounting portion configured and positioned to detachably mount the process cartridge, the process cartridge including:

an electrophotographic photosensitive drum;

a developing member configured and positioned to develop an electrostatic latent image formed on the electrophotographic photosensitive drum;

a developer accommodating portion configured and positioned to accommodate a developer to be used for developing of the electrostatic latent image by the developing member;

a developer moving member configured and positioned to move the developer accommodated in the developer accommodating portion toward the developing member;

a cartridge positioning portion configured and positioned to engage main assembly positioning portion provided in a main assembly of said apparatus to position the process cartridge relative the main assembly of said apparatus, the cartridge positioning portion being disposed at a developer accommodating portion side of the cartridge with respect to a direction crossing a direction of an axis of the electrophotographic photosensitive drum;

a photosensitive drum driving force receiving portion configured and positioned to receive a driving force for rotating the electrophotographic photosensitive drum from the main assembly of said apparatus when the process cartridge is mounted into the main assembly of said apparatus, the photosensitive drum driving force receiving portion being provided on one end of the photosensitive drum and being disposed at a leading side of the cartridge with respect to a direction of mounting the process cartridge to the main assembly of said apparatus, the photosensitive drum driving force receiving portion including a twisted prism which has a substantially triangular cross-section and which is engageable with a twisted recess having a substantially triangular cross-section and provided in the main assembly of said apparatus, wherein the process cartridge is mounted to the main assembly of said apparatus in the direction of the axis the electrophotographic photosensitive drum;

a moving member driving force receiving portion configured and positioned to receive a driving force for rotating the developer moving member from the main assembly of said apparatus when the process cartridge is mounted to the main assembly of said apparatus, wherein the moving member driving force receiving portion is disposed at the leading side of the cartridge with respect to the direction of mounting the process cartridge to the main assembly of said apparatus, wherein the moving member driving force receiving portion is operatively engageable with a driving force transmitting member provided in the main assembly of said apparatus irrespective of any eccentricity relative to the driving force transmitting member, wherein the rotational directions of the photosensitive drum driving force receiving portion and the moving member driving force receiving portion, when the photosensitive drum driving force receiving portion and the moving member driving force receiving portion receive driving forces from the main assembly of said apparatus, are the same, and the rotational directions are such that a rotation moment is produced so as to contact the cartridge positioning portion to the main assembly positioning portion of said apparatus, wherein the twisted recess and the twisted prism provide a centering function relative to each other, and the moving member driving force receiving portion receives the driving force for rotating the developer moving member without preventing the centering function between the twisted recess and the twisted prism.

* * * * *

UNITED STATES PATENT AND TRADEMARK OFFICE

CERTIFICATE OF CORRECTION

PATENT NO. : 6,823,155 B2
DATED : November 23, 2004
INVENTOR(S) : Tsuda et al.

It is certified that error appears in the above-identified patent and that said Letters Patent is hereby corrected as shown below:

Title page,
Item [56], References Cited, U.S. PATENT DOCUMENTS,
"2002/0012546 Al 1/2002 Chandai …… 399/106" should read
-- 2002/0012546 Al 1/2002 Chanadi …… 399/106 --.

Column 5,
Line 35, "Was" should read -- as --.

Column 7,
Line 24, "drum" should read -- drum 11. --.

Column 8,
Line 58, "Same" should read -- frame --.

Column 17,
Line 38, “joggle:" should read -- joggle --.

Column 18,
Line 24, "drum 1ℓ." should read -- drum 11 --.

Column 20,
Line 47, "to" should be deleted.

Column 22,
Line 59, "source." should read -- source --.

Column 24,
Line 62, "gear 10a." should read -- gear 110a. --.

Column 25,
Line 65, "gear 111cat" should read -- gear 111c at --.

Column 27,
Line 36, "ink" should read -- in --.

Column 29,
Line 17, "of apparatus" should read -- of the apparatus --.
Line 35, "portion" should read -- portion, --.
Line 62, "a" (second occurrence) should be deleted.

UNITED STATES PATENT AND TRADEMARK OFFICE

CERTIFICATE OF CORRECTION

PATENT NO. : 6,823,155 B2
DATED : November 23, 2004
INVENTOR(S) : Tsuda et al.

It is certified that error appears in the above-identified patent and that said Letters Patent is hereby corrected as shown below:

Column 30,
Line 50, "receives, a" should read -- receives, at a --.

Column 31,
Line 8, "engage main" should read -- engage a main --.
Line 10, "relative the" should read -- relative to the --.
Line 35, "the" should read -- of the --.

Signed and Sealed this

Nineteenth Day of April, 2005

JON W. DUDAS
*Director of the United States Patent and Trademark Office*